US007722509B2

(12) United States Patent
Eder

(10) Patent No.: US 7,722,509 B2
(45) Date of Patent: May 25, 2010

(54) HANDICAPPED ACCESSIBLE EXERCISE MACHINE

(76) Inventor: James Ryan Eder, 6407 Skimmer La., Columbus, OH (US) 43230

( * ) Notice: Subject to any disclaimer, the term of this patent is extended or adjusted under 35 U.S.C. 154(b) by 0 days.

(21) Appl. No.: 12/132,833

(22) Filed: Jun. 4, 2008

(65) Prior Publication Data

US 2008/0300116 A1 Dec. 4, 2008

Related U.S. Application Data

(60) Provisional application No. 60/941,845, filed on Jun. 4, 2007.

(51) Int. Cl.
*A63B 21/062* (2006.01)
*A63B 21/00* (2006.01)

(52) U.S. Cl. ..... 482/99; 482/101; 482/138

(58) Field of Classification Search ..... 482/99–103, 482/133–138

See application file for complete search history.

(56) References Cited

U.S. PATENT DOCUMENTS

| | | | | |
|---|---|---|---|---|
| 1,922,418 | A | 8/1933 | Conant | |
| 4,010,948 | A | 3/1977 | Deluty | |
| 4,411,424 | A | 10/1983 | Barnett | |
| 5,102,122 | A * | 4/1992 | Piane et al. | 482/133 |
| 5,123,886 | A | 6/1992 | Cook | |
| 5,277,685 | A | 1/1994 | Gonzales | |
| 5,603,682 | A | 2/1997 | Grider | |
| 6,033,350 | A | 3/2000 | Krull | |
| 6,120,421 | A | 9/2000 | Kuo | |
| 6,224,519 | B1 | 5/2001 | Doolittle | |
| 6,238,323 | B1 | 5/2001 | Simonson | |
| 6,443,877 | B1 * | 9/2002 | Hoecht et al. | 482/103 |
| 6,443,878 | B1 | 9/2002 | Webber | |
| 6,599,223 | B2 | 7/2003 | Wang et al. | |
| 7,166,066 | B2 | 1/2007 | Webber | |
| 7,179,209 | B2 * | 2/2007 | Sechrest et al. | 482/103 |
| 7,282,016 | B2 * | 10/2007 | Simonson | 482/103 |
| 7,335,141 | B2 * | 2/2008 | Piane, Jr. | 482/99 |
| 7,485,076 | B2 * | 2/2009 | Lee | 482/99 |
| 2002/0025888 | A1 | 2/2002 | Germanton et al. | |
| 2003/0045406 | A1 * | 3/2003 | Stone | 482/100 |
| 2004/0029688 | A1 | 2/2004 | Webber et al. | |
| 2005/0272573 | A1 * | 12/2005 | Carter | 482/99 |
| 2006/0105893 | A1 | 5/2006 | Chen | |
| 2006/0205571 | A1 | 9/2006 | Krull | |
| 2006/0217245 | A1 | 9/2006 | Golesh et al. | |
| 2006/0240956 | A1 * | 10/2006 | Piane, Jr. | 482/94 |
| 2007/0072748 | A1 | 3/2007 | Lee | |
| 2007/0161472 | A1 * | 7/2007 | Drechsler | 482/100 |
| 2007/0213185 | A1 | 9/2007 | Habing | |

* cited by examiner

*Primary Examiner*—Fenn C Mathew
(74) *Attorney, Agent, or Firm*—Jason H. Foster; Kremblas & Foster

(57) ABSTRACT

A handicapped accessible exercise apparatus having a central housing with two pivoting extension arms. Cables extend from weight stacks within the housing to movable cable guides on the arms for engagement by a user. By adjusting the positions of the arms and the cable guides, the apparatus can be configured to facilitate various exercises and to accommodate users of various sizes. The apparatus is provided with button-operated locks for allowing users with limited manual dexterity to easily lock and unlock the positions of the extension arms and the cable guides.

24 Claims, 24 Drawing Sheets

HANDICAPPED ACCESSIBLE EXERCISE MACHINE

CROSS-REFERENCES TO RELATED APPLICATIONS (Not Applicable)

This application claims the benefit of U.S. Provisional Application No. 60/941,845 filed Jun. 4, 2007.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

1. Field of the Invention

This invention relates generally to exercise equipment and more particularly to a handicapped accessible exercise machine that incorporates a number of features to simplify operation for users having limited mobility and/or dexterity.

2. Description of the Related Art

The vast majority of weight training machines that are currently available on the market are designed to accommodate users who possess a full or nearly full range of physical mobility and dexterity. Such machines often incorporate features that require a user to perform intricate manual adjustments to attach and adjust various components, or that require users to position and orient their bodies in tight spaces to accommodate the machines' seating and muscle isolation structures (i.e., benches, backrests, support pads, etc). These features make it difficult, and sometimes impossible, for handicapped users having limited mobility and dexterity to effectively use the machines. For example, a wheelchair-bound paraplegic user may not be able to lift himself onto a bench or move into a cramped space behind the chest pad of a traditional weight machine. Similarly, a user having diminished finger dexterity may have a great deal of difficulty operating conventional spring-loaded locking pins of the type commonly used in weight machines for securing the positions of the machine's adjustable components.

Due to the spatial requirements of a wheelchair and the limited mobility of a wheelchair's occupant, most weight training machines that are designed for wheelchair-bound users feature highly specialized structures and configurations. The components of such machines must be specially positioned and oriented for accommodating the size and shape of the wheelchair and the seated position of the user, while at the same time isolating the user's muscles in an effective manner. The result of this high degree of specialization is that conventional "wheelchair friendly" machines have traditionally exhibited a lack of versatility. Most of these machines are very large and very expensive, but are only capable of facilitating a single type of exercise. A wheelchair-bound individual must therefore use a variety of different specialized machines to perform a complete workout. Moreover, most weight machines that are designed for accommodating wheelchairs are poorly suited for users who do not use wheelchairs. Therefore, in order for a training facility to provide a complete array of wheelchair friendly equipment, the facility must spend a great deal of money and allocate a great deal of floor space to purchase and accommodate a plurality of machines that are largely unusable by the non-wheelchair-bound majority of its clientele. Such an investment is not economically practical for most facilities, thus leaving wheelchair-bound individuals with limited and ill-suited options for weight training.

It is therefore desirable to have a weight training machine that can be easily and effectively used by handicapped individuals and non-handicapped individuals alike that is able to facilitate a wide variety of different exercises.

BRIEF SUMMARY OF THE INVENTION

The present invention relates to a weight lifting machine that incorporates several features for allowing both able-bodied users and users with limited mobility and/or dexterity to easily and effectively perform a wide variety of weightlifting exercises.

The apparatus of the present invention preferably includes a central housing with two weight stacks enclosed therein. Two extension arms are pivotably mounted to opposite sides of the housing. Each arm can be releasably locked in a pivoted position relative to the housing. Each arm has a cable guide that can be slidably moved and releasably locked along the length of its respective arm. Cables are linked to each weight stack and extend to the cable guides through a series of pulleys in the manner of a conventional weightlifting machine. A user may thus connect a user interface, such as a handlebar, rope, or strap to the cables for performing various exercises. It is preferred that the cables terminate in J-hooks so that a user with limited manual dexterity can easily connect and disconnect various user interfaces.

By adjusting the angular positions of the extension arms relative to the housing and the longitudinal positions of the cable guides relative to the arms, the configuration of the apparatus can be modified to accommodate users of all body types, as well as to facilitate a broad range of weight machine exercises, such as curls, pull downs, crossovers, shrugs, and presses.

Button-operated push-locks are preferably mounted to the apparatus for allowing the adjusted positions of the extension arms and the cable guides to be releasably secured. Each of the push-locks operates in the manner of a conventional click-pen and allows a user to lock and unlock the positions of the arms and the guides by successively pressing a button. The push-locks are incorporated as an alternative to conventional, spring-loaded locking pins for allowing users with diminished finger dexterity to easily adjust and secure the configuration of the apparatus.

A resistance assembly is preferably located within the central housing and includes a solenoid tower having two solenoid driven pins mounted to vertically movable tracks. The solenoid tower is operatively connected to a user interface located on the front of the housing. The user interface is provided with a plurality of buttons that each correspond to weight increments of the weight stacks in the central housing. When a user presses a button that corresponds to a desired weight increment, the solenoid tower shifts locking pins into engagement with the appropriate weights in the weight stacks to offer the desired amount of resistance. The solenoid tower and the user interface are provided as an alternative to conventional, spring-loaded locking pins for allowing users with diminished finger dexterity to easily adjust the amount of resistance provided by the apparatus.

An adjustable support pad preferably extends from the front of the central housing for restricting the movement of a user relative to the central housing and allowing a user to isolate specific muscle groups while performing a workout. The pad can preferably be extended, retracted, and vertically pivoted relative to the housing for accommodating different users and different exercises. Button-operated solenoids are preferably provided for allowing a user to easily lock the pad in various positions along its range of motion.

A wheelchair stabilization member preferably extends from the base of the central housing and preferably includes a plurality of retractable cables that extend from two laterally-opposing arms. Each cable terminates in a fastening hook and can be releasably locked in an extended position by a button-operated lock. A user can secure his wheelchair against movement relative to the central housing by positioning his wheelchair between the arms, extending the retracting cables from the arms, mounting the fastening hooks to his wheelchair, and locking the cables with the button-operated locks.

A sliding bench is preferably provided by allowing non-wheelchair bound users to operate the apparatus in a seated position. The bench incorporates a spring-loaded catch that mates with a docking bar on the central housing for locking the bench to the housing. A handle preferably protrudes from the front of the bench and is operatively coupled to the catch for allowing a user to unlock the bench from the housing by pulling the handle.

Figure 1:
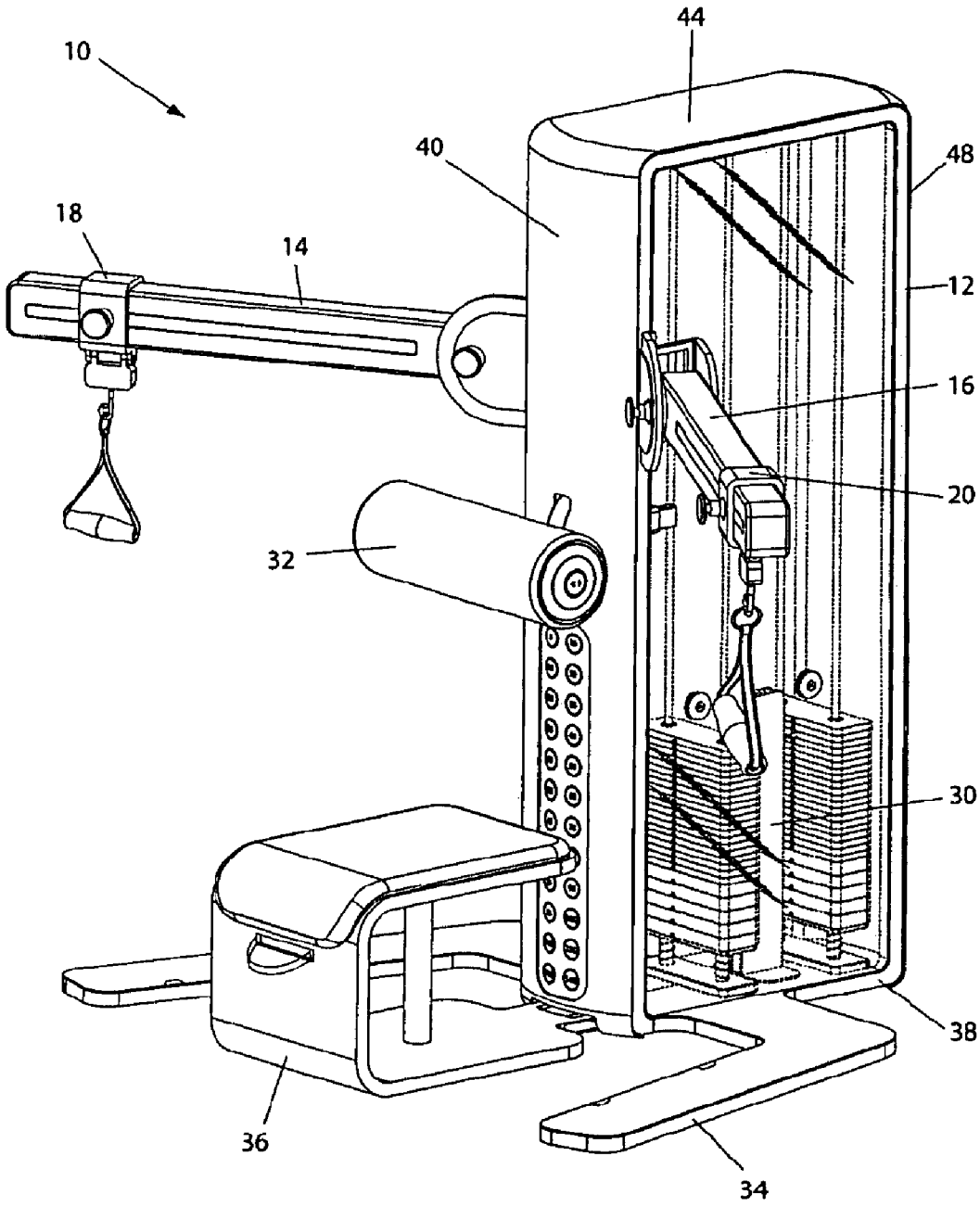
FIG. 1 is a perspective view illustrating the preferred embodiment of the present invention.
Figure 2:
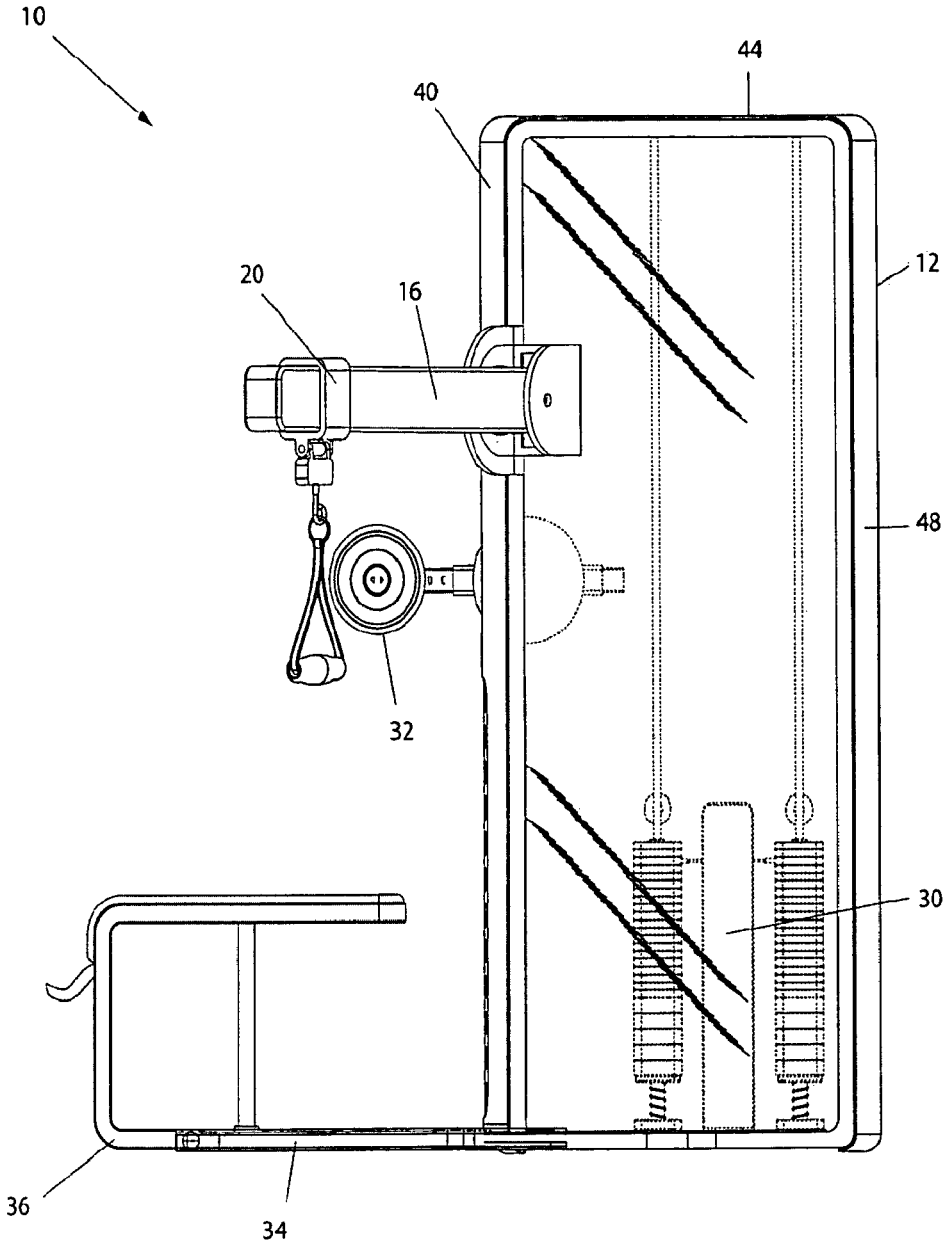
FIG. 2 is a right side view illustrating the preferred embodiment of the present invention shown in FIG. 1.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

As shown in FIGS. 1-4, the exercise machine 10 is generally provided with a central housing 12, pivoting extension arms 14 and 16, sliding cable guides 18 and 20, independent cable systems 22 and 24, user interfaces 26 and 28, a resistance assembly 30, an adjustable support pad 32, a wheelchair stabilization member 34, and a sliding bench 36. For the sake of convenience and clarity, terms such as "front," "rear," "top," "bottom," "up," "down," "inwardly," "outwardly," "lateral," and "longitudinal" will be used herein to describe the relative placement and orientation of various components of the invention, all with respect to the geometry and orientation of the machine 10 as it appears in FIG. 1. Said terminology will include the words specifically mentioned, derivatives thereof, and words of similar import.

The central housing 12 is a vertically elongated, generally rectangular enclosure having a base 38, a front wall 40, a rear wall 42, and a top 44 that are preferably formed of steel, although all other sufficiently rigid and durable materials, including, but not limited to aluminum, plastic, and various composites, are contemplated. The housing 12 additionally includes two removable sidewalls 46 and 48 (sidewall 46 is not within view, but is substantially identical to sidewall 48) that are preferably formed of polymethyl methacrylic (PMMA or "acrylic glass"). The sidewalls 46 and 48 prevent users from extending their limbs into the interior of the housing 12 while providing visibility of the resistance assembly 30 and cable systems 22 and 24 (described in greater detail below). Although it is preferred that the sidewalls 46 and 48 be formed of a transparent or partially transparent material, it is contemplated that the sidewalls 46 and 48 can be formed of any suitably rigid material, including, but not limited to steel, aluminum, glass, and various composites. The sidewalls 46 and 48 are mounted to the rest of the housing 12 by any conventional means, such as by removable fasteners, magnetic brackets, and/or hinges. One or both of the sidewalls 46 and 48 may thus be removed or pivoted open for allowing convenient access to the interior of the housing 12 for maintenance or repair. It is contemplated that one or both of the sidewalls 46 and 48 may alternatively be omitted, thereby leaving the interior of the housing 12 exposed.

Figure 3:
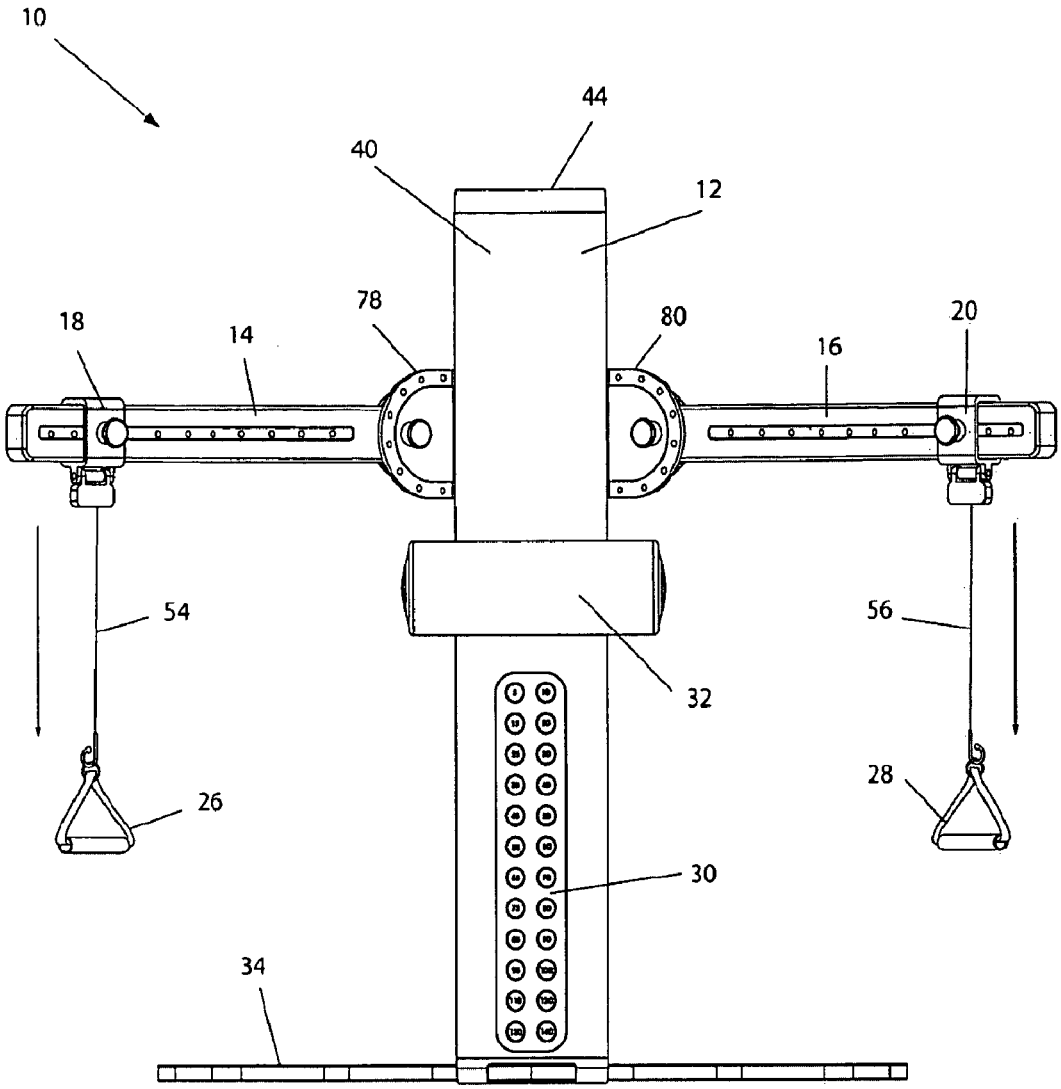
FIG. 3 is a front view illustrating the preferred embodiment of the present invention shown in FIG. 1 with user interfaces attached and in extended positions.
Figure 4:
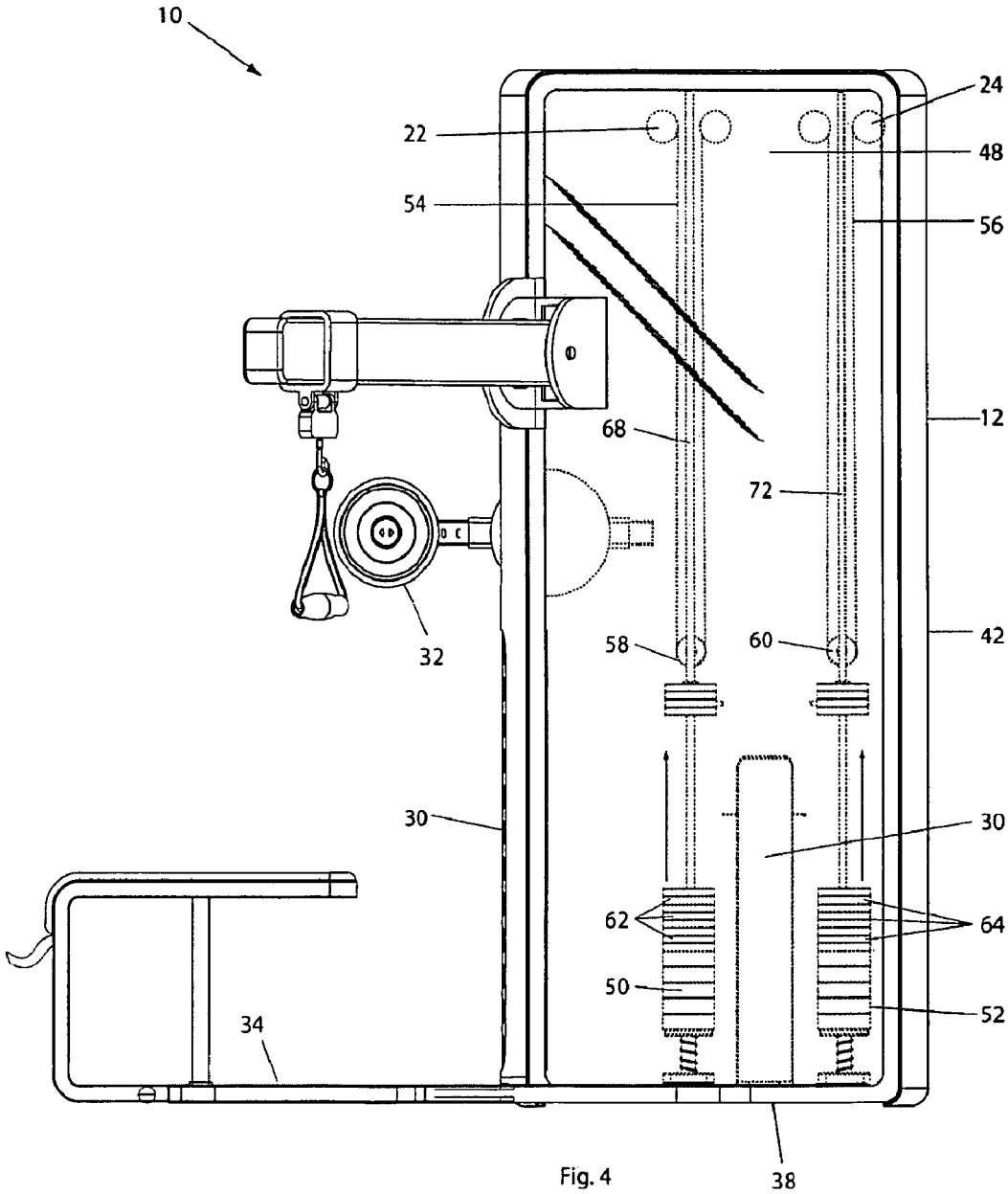
FIG. 4 is a right side view illustrating the preferred embodiment of the present invention shown in FIG. 1 with a number of weight plates shown in an elevated position and with the sliding bench removed.
Figure 23:
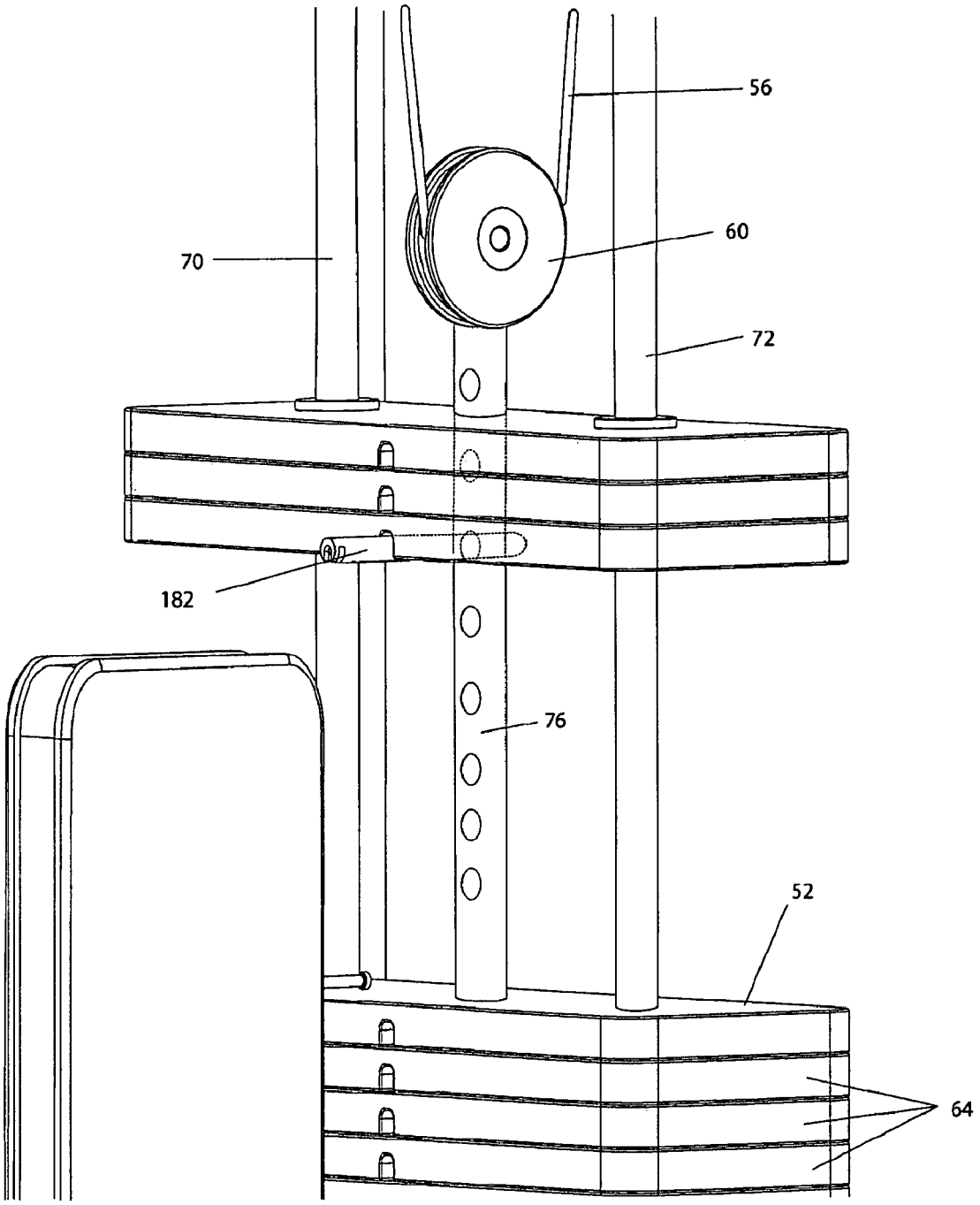
FIG. 23 is a detail view illustrating a weight stack of the present invention with several of the weight plates in an elevated position.

Referring to FIGS. 3, 4, and 23, each of the user interfaces 26 and 28 is coupled to one of the weight stacks 50 and 52 by a cable system 22 and 24 in the manner of a conventional exercise machine. In particular, each cable system 22 and 24 includes a flexible member 54 and 56 that extends from a user interface 26 and 28 and operatively engages a series of pulleys that is located in the extension arms 14 and 16 and within the central housing 12. Pulleys 58 and 60 in each series are mounted to lift shafts 74 and 76 (lift shaft 74 is not within view, but is substantially identical to shaft 76) that engage the weight stacks 50 and 52, respectively. When secured to a selected weight plate by a locking pin (described in greater detail below) each lift shaft 74 and 76 causes any tensile force applied to its corresponding user interface 26 and 28 to be transmitted to the lift shaft's respective weight stack 50 and 52. The flexible members 54 and 56 are formed of nylon cable, although various other flexible members including metal cables, ropes, cords, and chains of suitable tensile strength are contemplated.

Each weight stack 50 and 52 includes a plurality of conventional weight plates 62 and 64 that are slidably mounted on vertical support shafts 66, 68, 70, and 72 (See FIG. 23: shaft 66 is not within view, but is substantially identical to shafts 68-72). The configuration of the pulleys within the central housing 12 causes any force that is transmitted through either flexible member 54 and 56 to be directed toward lifting a predetermined number of weight plates of a corresponding weight stack 50 and 52 upwardly on a lift shaft 74 and 76, along the support shafts 66-72. Although a particular configuration of pulleys, flexible members, and weight stacks is represented in the previously described figures, it will be appreciated that various other conventional and equivalent configurations are contemplated for achieving similar operative relationships. For example, it is contemplated that a single flexible member can be used to link both user interfaces to a single weight stack.

Figure 5:
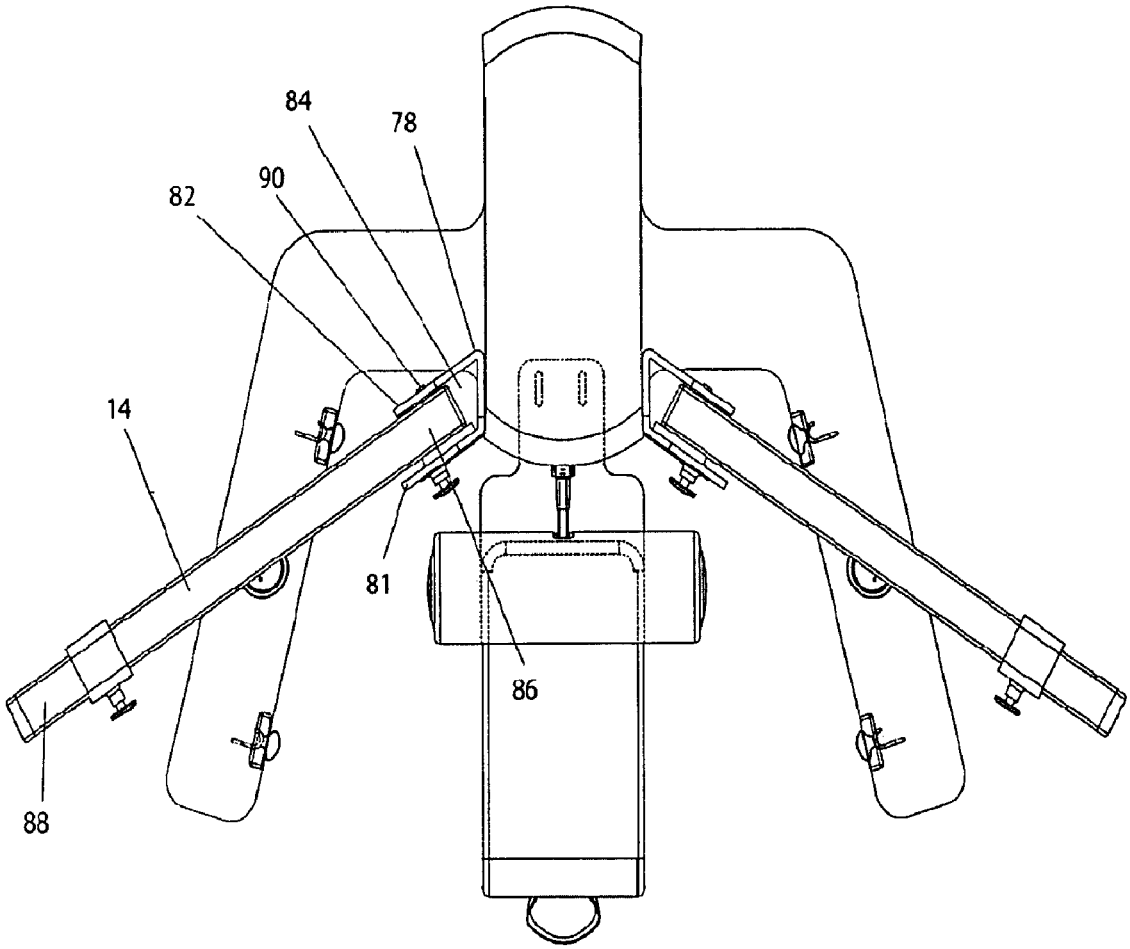
FIG. 5 is a top view illustrating the preferred embodiment of the present invention shown in FIG. 1 with the sliding bench removed.
Figure 6:
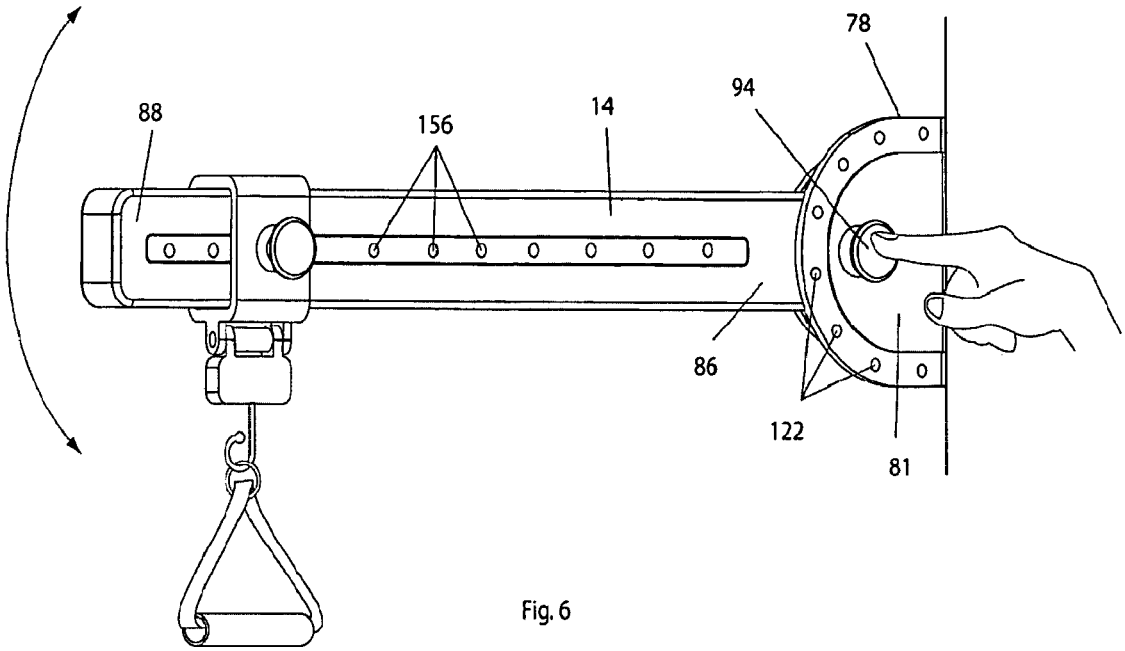
FIG. 6 is a perspective view illustrating the mounting bracket and push-lock of the left extension arm of the preferred embodiment of the present invention.

Referring now to FIG. 3, the extension arms 14 and 16 are coupled to the mounting brackets 78 and 80 that extend laterally from opposite sides of the front wall 40. The cable guides 18 and 20 fit over the extension arms 14 and 16 for allowing the user interfaces 26 and 28 to be adjustably positioned relative to the arms 14 and 16. The extension arms 14 and 16, mounting brackets 78 and 80, cable guides 18 and 20, and user interfaces 26 and 28 on either side of the exercise machine 10 are substantially identical, and will now be described with reference to the components on the left side of the machine 10 only. Referring to FIGS. 5 and 6, the mounting bracket 78 is a generally U-shaped member (as viewed from above) that includes front and rear mounting plates 81 and 82. The plates 81 and 82 are vertically oriented and are parallel to one another to form a vertical channel 84 of predetermined width therebetween. The plates 81 and 82 extend forward from the housing 12 at a preferred angle of about 30 degrees, although any angle in the range of about 0 degrees to about 90 degrees is contemplated.

The extension arm 14 is an elongated, hollow, and generally rectangular member. The arm 14 is preferably about four feet in length, although any length in a range of about 2 feet to about 8 feet is contemplated. The extension arm 14 has a proximal end 86 nearest the central housing 12 and a distal end 88 furthest from the housing. The arm 14 has an elongated cable slot (not within view) formed in its bottom surface that extends from adjacent the proximal end 86 to adjacent the distal end 88. The proximal end 86 of the arm 14 fits within the vertical channel 84 of the mounting bracket 78 and is pivotably mounted therein by an axle pin 90 that extends perpendicularly between, and that is rigidly mounted to, the front and rear mounting plates 81 and 82. The pin 90 extends through the extension arm 14 and engages conventional replaceable bearings located therein for allowing the arm 14 to smoothly pivot 90 degrees in either direction from the orientation shown in FIG. 3. The width of the extension arm 14 is substantially equal to the width of the vertical channel 84 for providing snug engagement between the arm 14 and the mounting bracket 78 without inhibiting the rotational movement of the arm 14.

Figure 8:
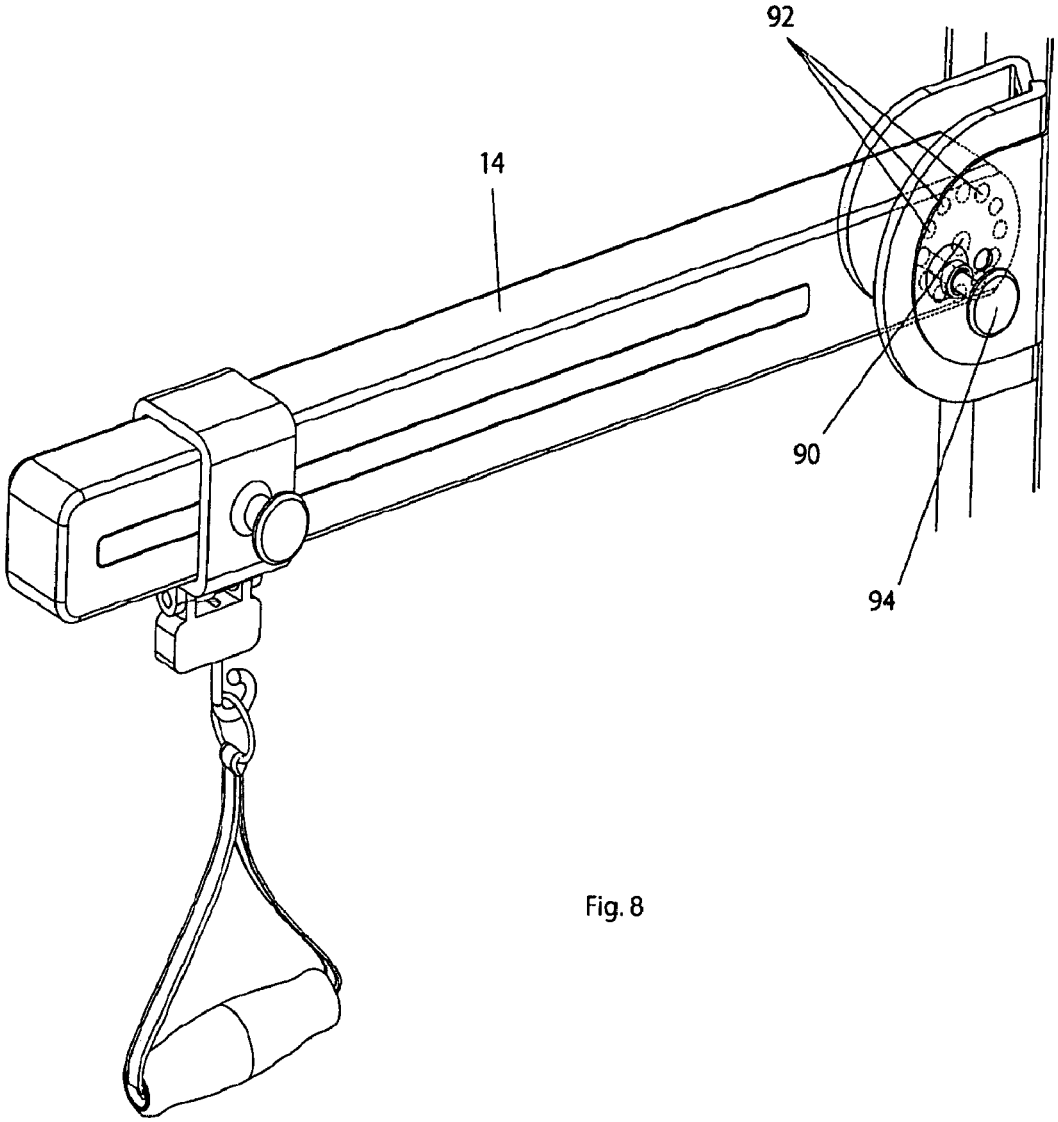
FIG. 8 is a perspective view illustrating the left arm of the preferred embodiment of the present invention with the proximal end of the arm shown in phantom.

Referring to FIG. 8, the extension arm 14 has a plurality of arm positioning holes 92 formed in its front surface in an evenly spaced, circular pattern coaxial with the axle pin 90. The locations of the positioning holes 92 correspond to securable angular positions of the extension arm 14 (described in greater detail below).

Figure 7A:
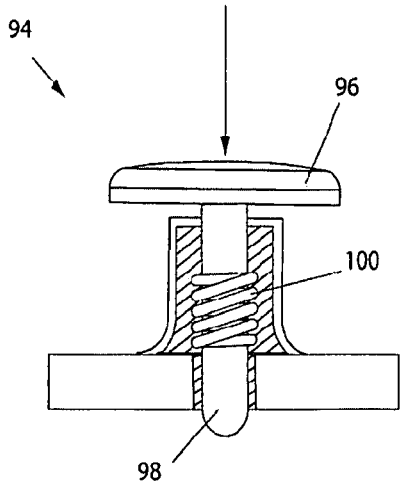
FIG. 7*a* is a detail view of the push-lock of the left extension arm shown in a locked position.
Figure 7B:
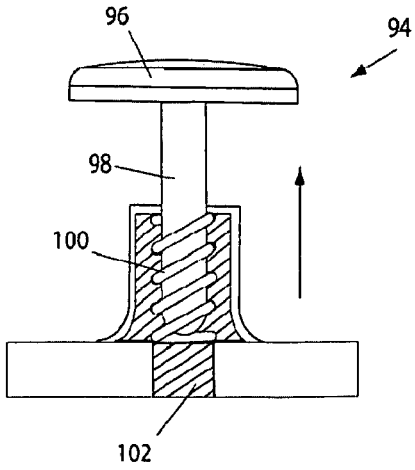
FIG. 7*b* is a detail view of the push-lock of the left extension arm shown in an unlocked position.

Referring to FIGS. 6-8, a push-lock 94 is located on the front plate 81 of the mounting bracket 78 intermediate the axle pin 90 and the edge of the bracket 78. The push-lock 94 is a spring-loaded locking mechanism that is generally provided with a button 96, a shaft 98, a spring 100, and a catch (not pictured). The push-lock 94 operates in the manner of a conventional click-pen, allowing a user to move the shaft 98 axially between a locked position (as shown in FIG. 7*a*) and an unlocked position (as shown in FIG. 7*b*) by pressing or striking the head with a moderate amount of force. For example, if the push-lock 94 is in an unlocked position and a user exerts sufficient axial force on the button 96 to overcome the resistance of the spring 100, the spring 100 becomes compressed, which forces the catch into engagement with the spring 100, thereby securing the shaft 98 in a locked position. Conversely, if the push-lock 94 is in a locked position and a user exerts sufficient axial force on the button 96 to overcome the resistance of the partially compressed spring 100, the spring 100 is compressed further, which forces the catch to release the spring 100, thereby allowing the spring 100 and the shaft 98 to extend to their unlocked positions.

The push-lock 94 is thus used as a convenient substitute for a conventional locking pin of the type commonly used in traditional exercise machines for adjustably securing component positions and weight increments. Unlike a locking pin, the push-lock 94 can be easily operated by users having limited manual dexterity. Whereas the manipulation of a conventional locking pin requires a great deal of finger dexterity, the push-lock requires little or no manual dexterity and can be easily operated with a fist, the flat of a hand, a forearm, or even an elbow.

Referring to FIGS. 7*b* and 8, the shaft 98 of the push-lock 94 is axially aligned with an arm locking hole 102 formed in the front plate 81. The distance between the locking hole 102 and the axle pin 90 is equal to the radius of the circle about which the arm positioning holes 92 are disposed. By pivoting the extension arm 14 about the axle pin 90, the various positioning holes 92 can be arcuately shifted into and out of axial alignment with the arm locking hole 102. When a positioning hole corresponding to a desired angular position of the extension arm 14 is moved into alignment with the locking hole 102, the push-lock 94 can be engaged, thereby forcing the shaft 98 of the push-lock 94 into axial engagement with the two holes and locking the arm 14 against further angular movement.

Figure 9:
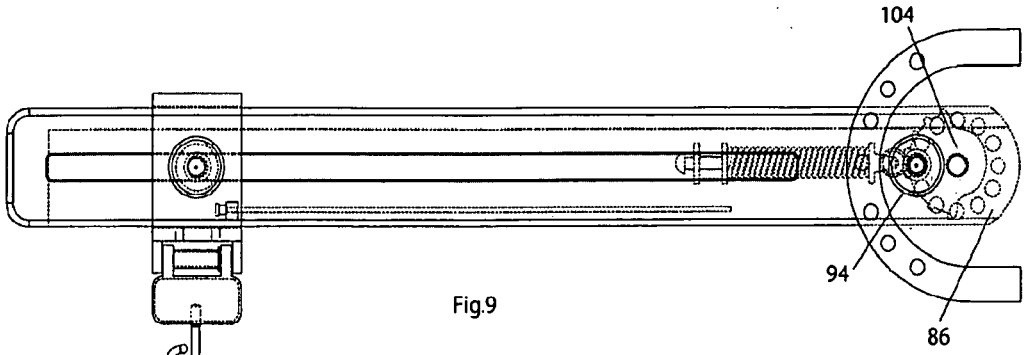
FIG. 9 is a front view illustrating the left arm of the preferred embodiment of the present invention with the positioning cam and the positioning aid show in phantom.
Figure 10:
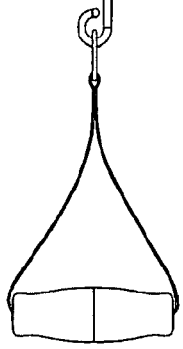
FIG. 10 is a front view illustrating the positioning cam and positioning aid of the left extension arm of the preferred embodiment of the present invention with the left extension arm show in phantom.
Figure 10:
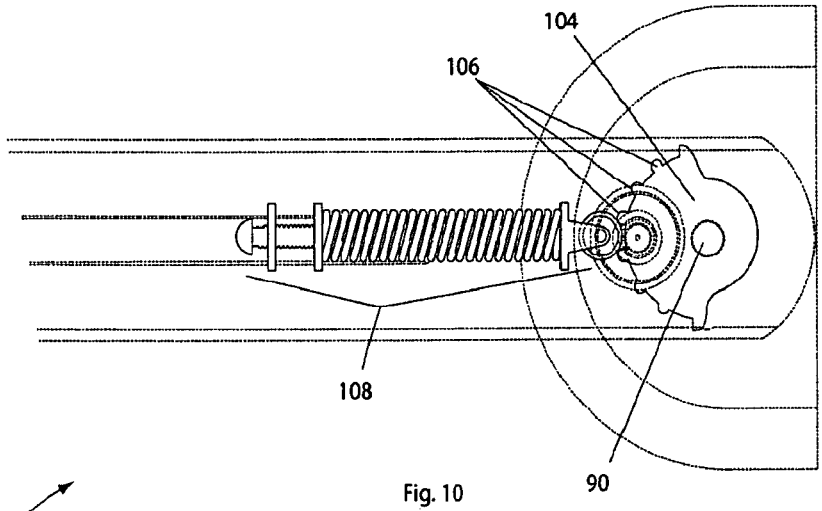
Figure 11:
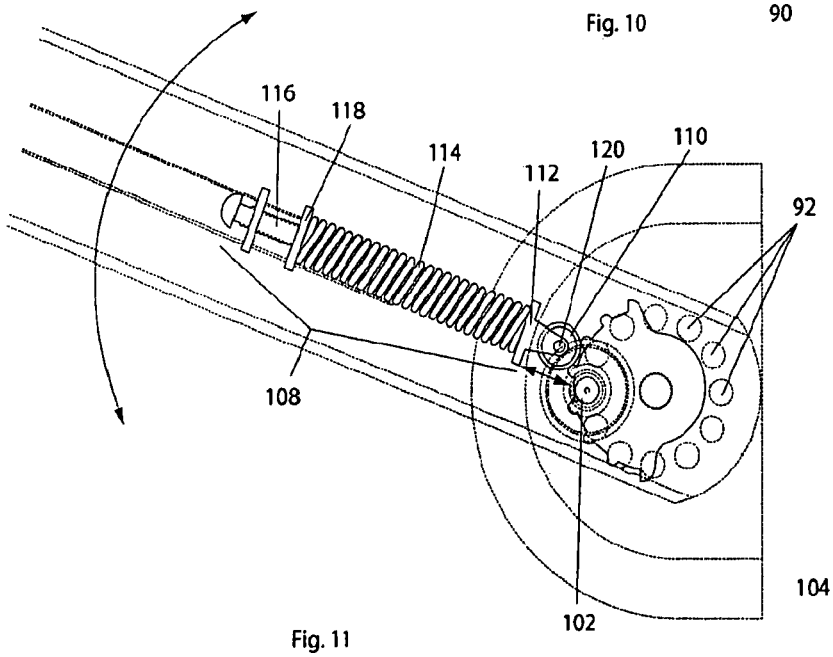
FIG. 11 is a front view illustrating the positioning cam and positioning aid of FIG. 10 in a rotated position.

Referring to FIGS. 9-11, a positioning cam 104 is located within the extension arm 14 adjacent the proximal end 86 of the arm 14. The cam 104 is rigidly mounted to the axle pin 90, and thus remains in a fixed orientation when the arm 14 is pivoted about the pin 90. The cam has a semi-circular, outwardly directed edge that features a plurality of evenly spaced, radially extending detents 106. Like the arm positioning holes 92, each of the detents 106 corresponds to a securable angular position of the extension arm 14 (described in greater detail below).

An adjustable, spring-loaded positioning aid 108 is located within the arm 14 adjacent the positioning cam 104. The positioning aid 108 generally includes a bearing 110, a bearing mount 112, a spring 114, a threaded adjustment screw 116, a fixed washer 117, and an adjustment washer 118. The fixed washer 117 is rigidly mounted to the interior of the arm 14 and its axis is radially oriented with respect to the axle pin 90. The adjustment screw 116 threadedly engages the fixed washer 117 and can be longitudinally displaced relative to the washer 117 by rotating the screw 116 about its axis. The adjustment washer 118 is rigidly fixed to adjustment screw 116. One end of the spring 114 fits over an end of the adjustment screw 116 and abuts the adjustment washer 118. The bearing mount 112 is rigidly affixed to the opposite end of the spring 114. The bearing 110 is a circular body that is rotatably mounted to the bearing mount 112 by an axle pin 120, thereby allowing the bearing 110 to rotate freely about its axis. The spring 114 holds the bearing 110 in firm engagement with the positioning cam 104. The amount of force exerted on the positioning cam 104 by the bearing 110 may thus be increased or decreased by rotating the adjustment screw 116 clockwise or counterclockwise about its axis to compress or decompress the spring 114.

When a user pivots the extension arm 14 about the axle pin (as indicated by the curved arrow in FIG. 11), the spring 114 compresses and extends (as indicated by the longitudinal arrow in FIG. 11) as the bearing 110 moves over and between the detents 106 of the cam 104. The engagement between the bearing 110 and the detents 106 provides a user with a palpable sensation as the user adjusts the angular position of the arm 14. Specifically, the arm 14 is slightly more difficult to rotate when the bearing 110 is moving over a detent 106 than when the bearing 110 is moving into a space between the detents 106. The detents 106 are positioned to indicate axial alignment between the arm locking hole 102 and an arm positioning hole 92 whenever the bearing 110 is positioned between two of the detents 106. A user is thus able to tell by manual sensation when the push-lock 94 can be effectively engaged in order to secure the arm 14 in a desired position.

In addition to providing an indication of alignment between the arm locking hole 102 and the arm positioning holes 92, the forceful engagement between the bearing 110 and the detents 106 of the cam 104 also acts as a counterbalance to the weight of the extension arm 14. That is, the radial force provided by the spring 114 is great enough to hold the bearing 110 in place between two of the detents 106 against the force of gravity acting on the extension arm 14. Thus, when a user unlocks the push-lock 94, the arm 14 will stay in place until the user shifts the arm 14 manually.

An alternative embodiment of the invention is contemplated in which the extension arm 14 is provided with a conventional counterweight on the proximal end of the arm 14 for allowing the arm 14 to be easily articulated by a user with the application of relatively little force. The counterweight can be formed of lead, iron, or any other suitably heavy material for counteracting the weight of the arm 14. The counterweight can be provided in addition to, or in lieu of, the spring-loaded positioning aid 108 described above. Alternatively, the arm 14 can be moved by a prime mover or any conventional power-operated device.

Referring to FIG. 6, a plurality of radially disposed alignment dots 122 are provided on the front surface of the front mounting plate for allowing a user to readily ascertain visually whether axial alignment exists between the arm locking hole 102 and an arm positioning hole 92. Specifically, the alignment dots are positioned to indicate axial alignment between the locking hole 102 and one of the positioning holes 92 when any of the dots 122 are longitudinally aligned with the guide cuff positioning holes 156 (described in greater detail below). A user is thus provided with a clear visual indication of alignment in addition to the palpable indication of alignment provided by the spring-loaded positioning aid 108.

The alignment dots 122 are preferably painted circles, although it is contemplated that any other visual indicia may alternatively be used to achieve the functionality described above, including, but not limited to holes, notches, ridges, tabs, depressions, and raised areas of various shapes and sizes.

Referring now to FIGS. 12-15, the cable guide 18 includes a guide cuff 128, a pivot extension 130, and a push-lock 132. The guide cuff 128 is a generally rectangular body having an opening that receives the extension arm 14 therethrough. The interior dimensions of the cuff 128 are slightly larger than the exterior dimensions of the extension arm 14 for permitting the guide cuff 128 to surround and slidably engage the arm 14. Thus, the cuff 128 snugly engages the extension arm 14 while allowing longitudinal sliding movement of the cuff 128 relative to the arm 14 for adjustment. The cuff 128 has a cable port 134 formed in its bottom wall. A cable termination bracket 136 extends upwardly from the bottom of the cuff 128, through an elongated cable slot formed in the bottom of the extension arm (not within view), and into the interior of the extension arm 14. A first end of the flexible member 54 is permanently affixed to the cable termination bracket 136, and a second end of the flexible member 54 extends downwardly from the cable slot and through the cable port 134.

The pivot extension 130 is a generally rectangular, hollow body that is pivotably mounted to the bottom of the guide cuff 128 by a hinge 138. The hinge 138 allows the extension 130 to freely pivot 180 degrees backwards and forwards (90 degrees in both directions from the position shown in FIG. 15). Two opposing pulleys 140 and 142 are rotatably mounted within the pivot extension 130 in a longitudinally close clearance relationship to form a vertical channel 144 therebetween. A cable inlet port 146 and a cable outlet port 148 are formed in the top and bottom surfaces of the pivot extension 130, respectively, for providing a vertical passageway through the extension 130. The flexible member 54 extends downwardly from the cable port 134 into the pivot extension 130, between the opposing pulleys 140 and 142, and terminates in a J-hook 146 (described in greater detail below) below the pulleys 140 and 142. The flexible member 54 thus extends from the J-hook 146, through the outlet port 134, around a first pulley 148, to the distal end 88 of the extension arm 14, around a second pulley 150, back to the proximal end 86 of the arm 14, through the rest of the of the cable system 22, back to the proximal end 86 of the arm 14, and finally terminates at the cable termination bracket 136.

Given the configuration of the cable guide 18 and positions of the two ends of the flexible member 54, any longitudinal movement of the guide 18 along the extension arm 14 results in a corresponding longitudinal movement of the ends of flexible member 54. The result of this relationship is that the guide 18 can be moved along the extension arm 14 while the flexible member 54 remains substantially taught, thereby obviating the need for any type of cable take-up means. For example, if the cable guide 18 is moved from the distal end 88 of the arm 14 toward the proximal end 86 of the arm 14, the movement of the first end of the flexible member 54 toward the housing 12 causes the member 54 to slacken, while the movement of the second end of the flexible member 54 toward the housing 12 simultaneously causes the member 54 to be pulled taught by an equal amount. The movement of the ends thus causes the entire flexible member 54 to cycle around all of the pulleys in the cable system 22.

Figure 12:
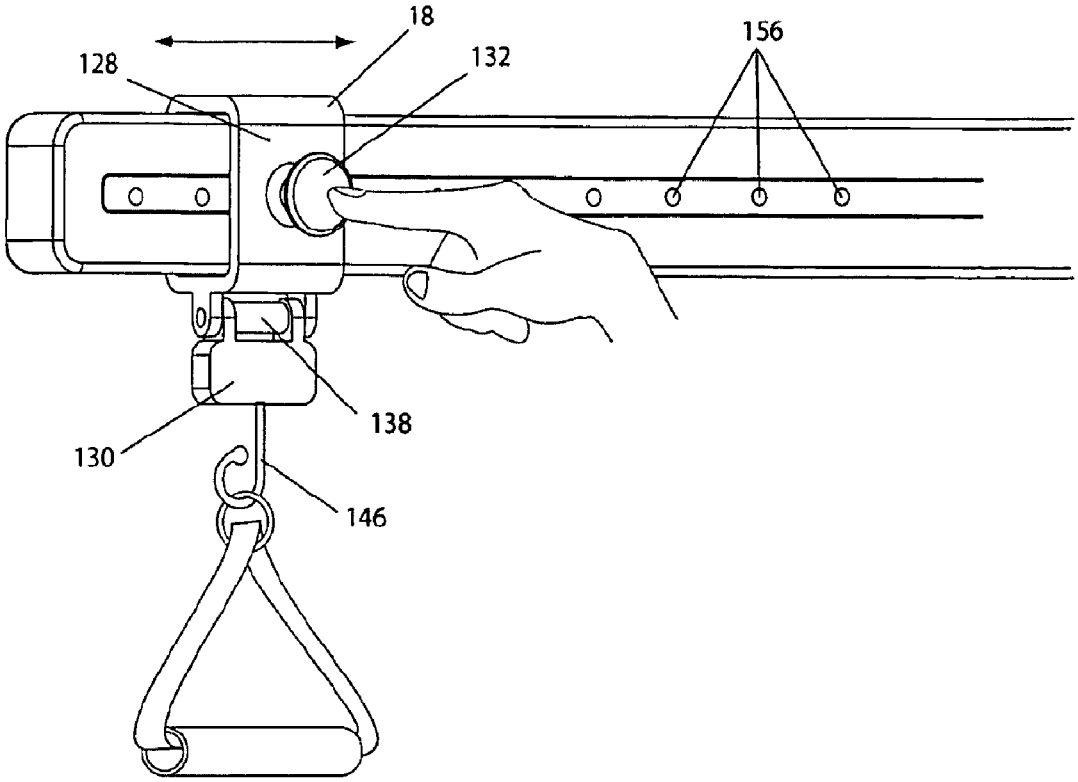
FIG. 12 is a perspective view illustrating the cable guide of the left arm of the preferred embodiment of the present invention.
Figure 13A:
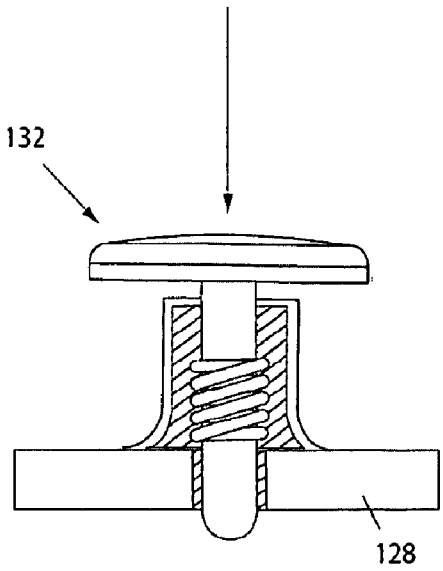
FIG. 13*a* is a detail view of the push-lock illustrating the cable guide of the left extension arm shown in a locked position.
Figure 13B:
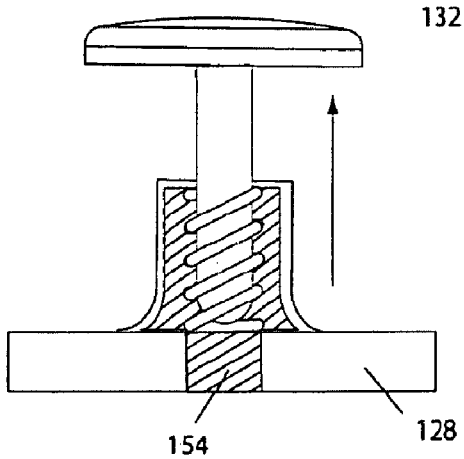
FIG. 13*b* is a detail view of the push-lock illustrating the cable guide of the left extension arm shown in an unlocked position.
Figure 14:
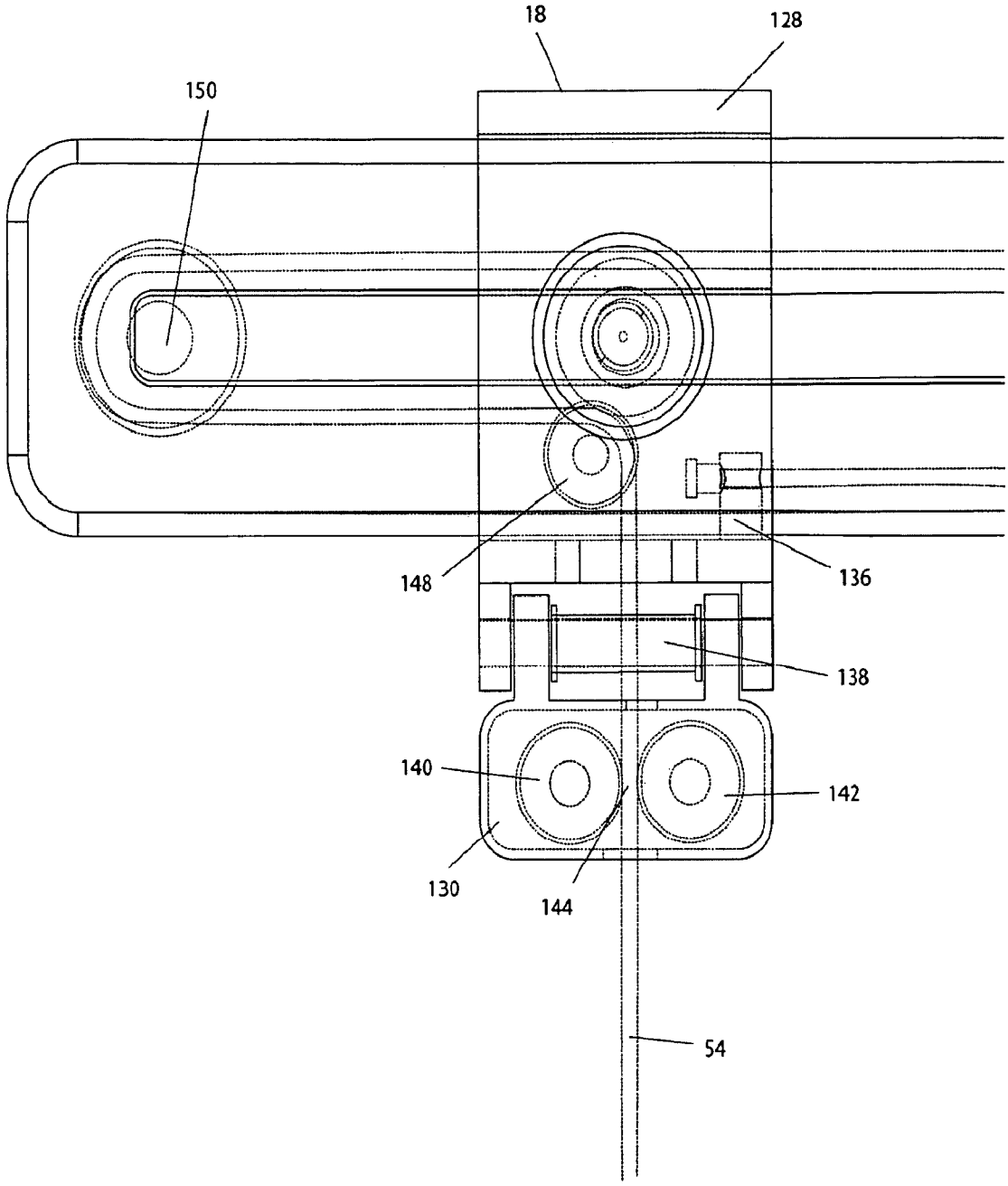
FIG. 14 is a detail view of the cable guide illustrating the left arm of the present invention with various components shown in phantom.
Figure 15:
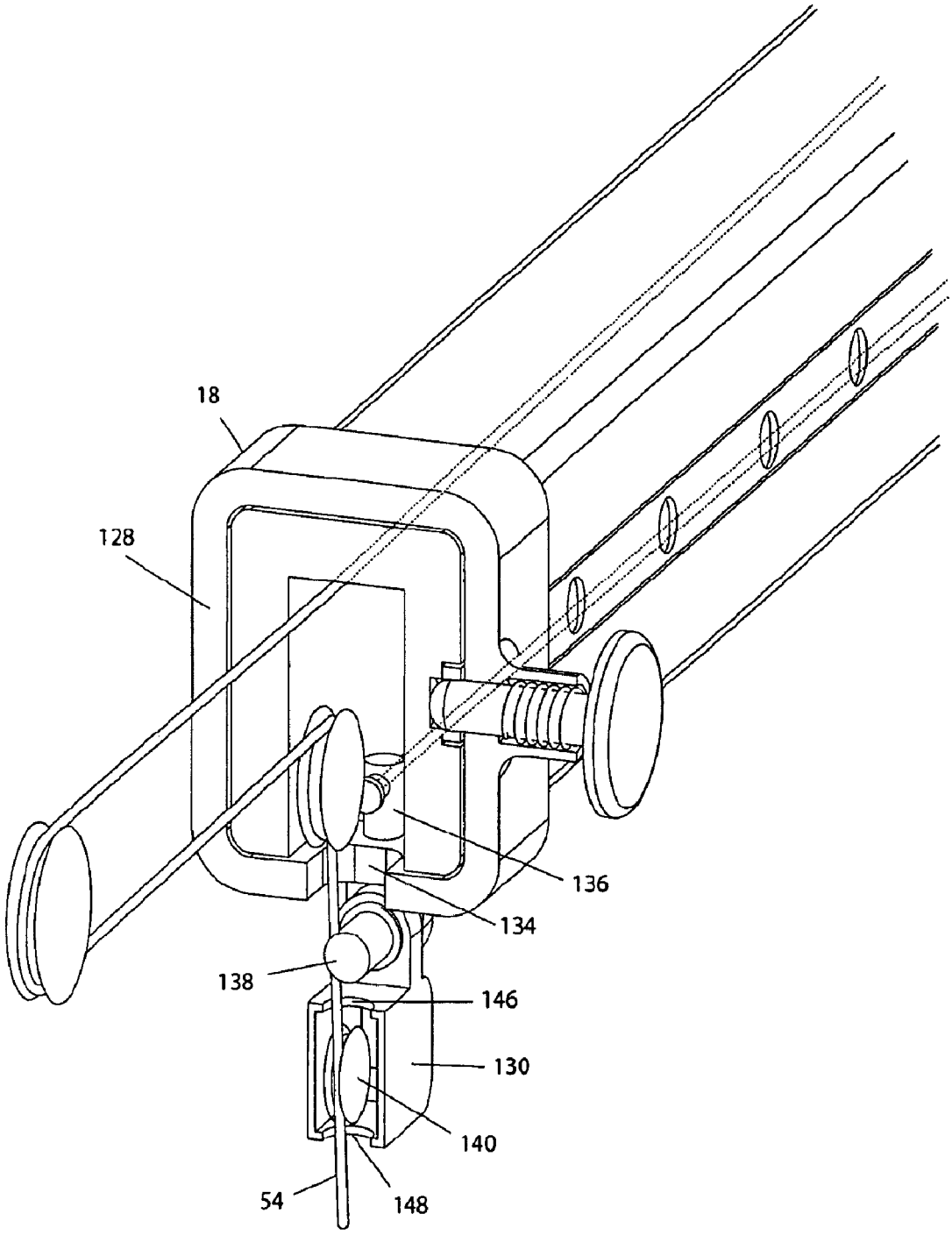
FIG. 15 is cross section view illustrating the interior of the cable guide of the left arm of the present invention.
Figure 16:
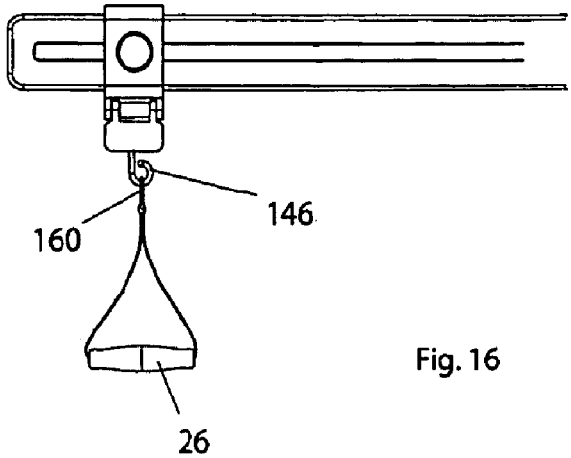
FIG. 16 is a front view illustrating the left arm of the present invention with a user interface mounted to the cable.

Referring to FIGS. 12, 13*a*, and 13*b*, the push-lock 132 is located on the front of the guide cuff 128. The push-lock 132 is substantially identical in structure and in function to the push-lock 94 described above. The shaft of the push-lock 132 is axially aligned with a guide cuff locking hole 154 that is formed in the front surface of the guide cuff 128. The extension arm 14 has a plurality of evenly spaced, longitudinally disposed guide cuff positioning holes 156 along its length. The guide cuff locking hole 154 is longitudinally aligned with each of the guide cuff positioning holes 156. In order to adjust the longitudinal position of the cable guide 18 relative to the extension arm 14, the guide cuff 128 is slid along the arm 14 while the push-lock 132 is in an unlocked position. When the desired position of the guide cuff 128 is reached, the cuff 128 is further adjusted to bring the guide cuff locking hole 154 into axial alignment with a nearest guide cuff positioning hole. The head of the push-lock 132 is then depressed, thereby forcing the shaft through the guide cuff locking hole 154 and into axial engagement with the selected guide cuff positioning hole 156 and securing the push-lock 132 in a locked position. The guide cuff 128 is thereby fixed against longitudinal movement along the extension arm 14 until the push-lock 132 is unlocked.

Figure 17:
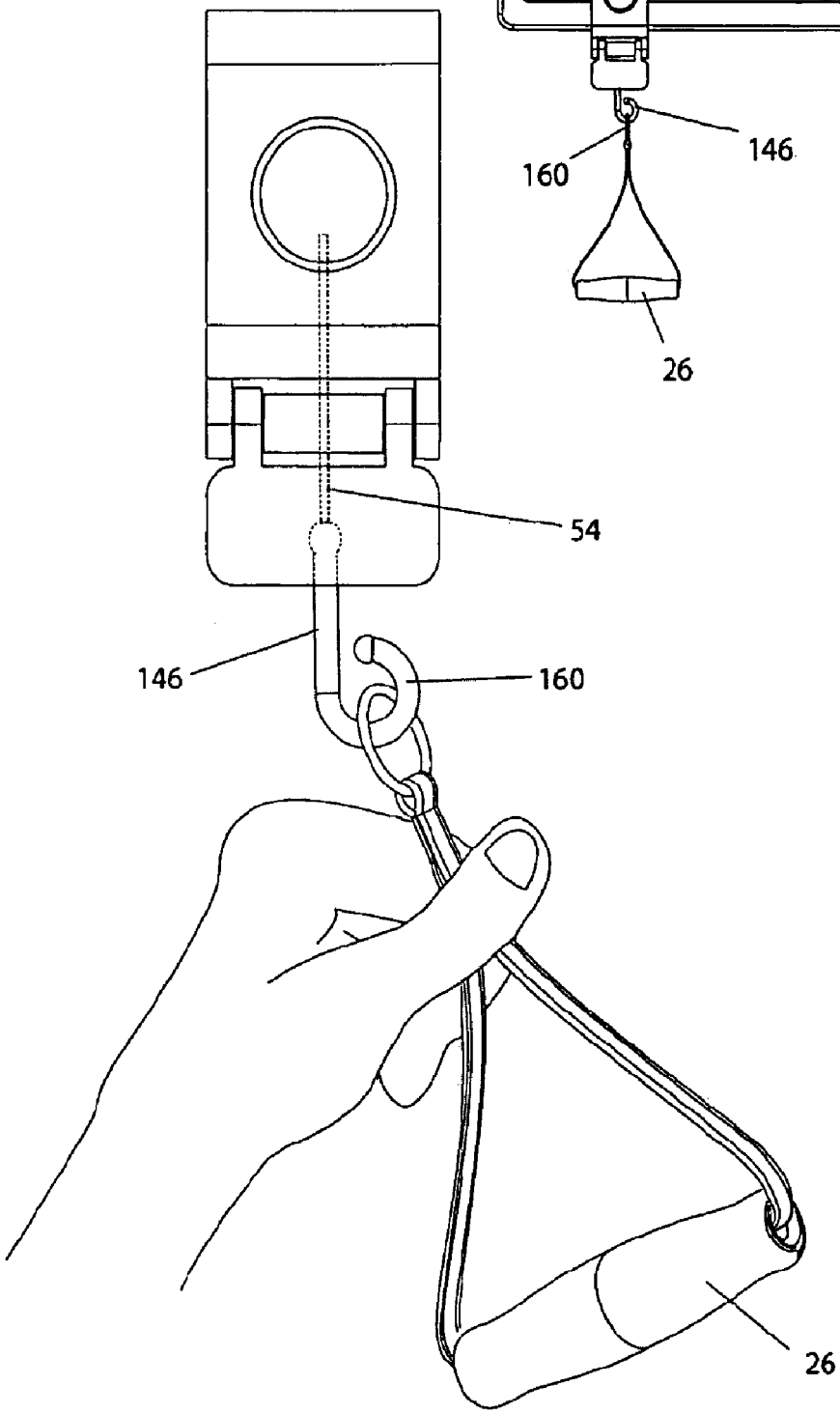
FIG. 17 is a front view illustrating the cable guide of the left arm of the present invention with a user interface mounted to the cable.
Figure 18:
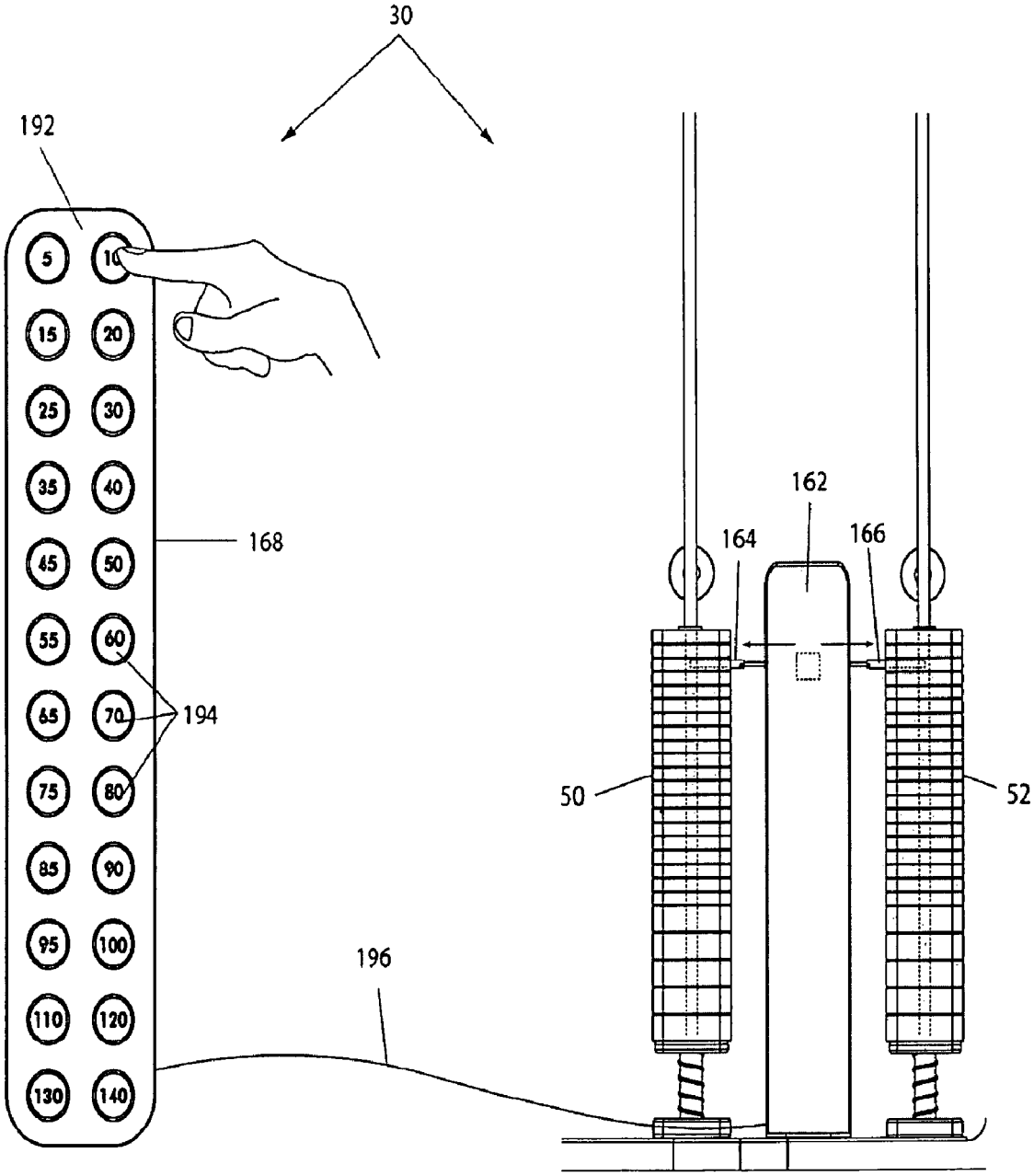
FIG. 18 is a detail view illustrating the resistance assembly of the present invention.
Figure 19:
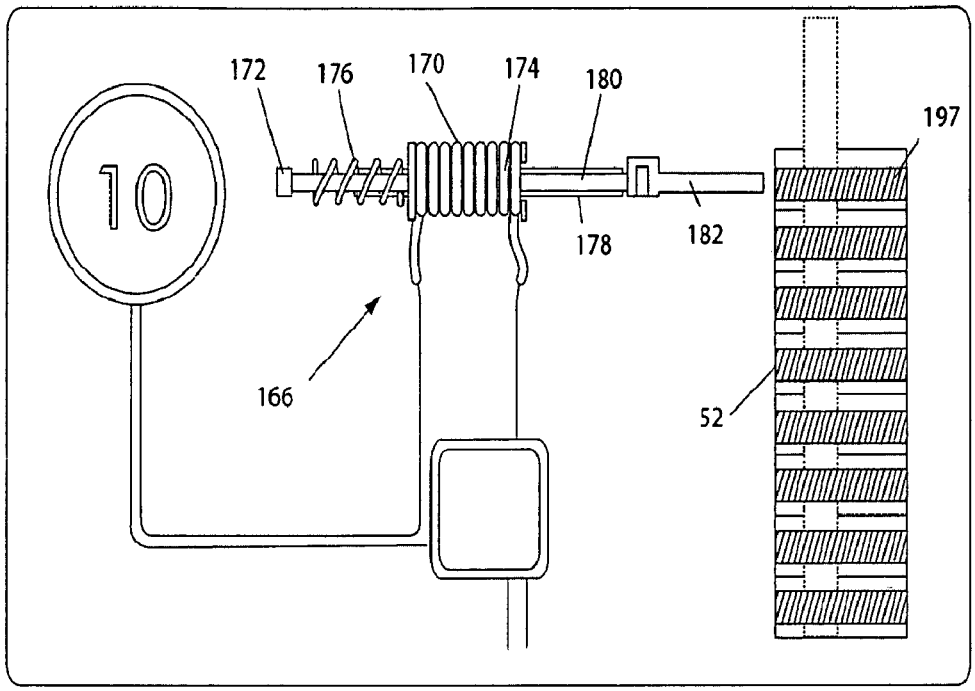
FIG. 19 is a detail view illustrating a pin driver of the resistance assembly shown in FIG. 18 with the pin disengaged from a weight plate.

Referring now to FIG. 17, the user interface 26 is operatively connected to the J-hook 146 by extending one end of the J-hook through an attachment ring 160. The user interface shown is a conventional cable machine handle, although it is contemplated that the interface can be any of a variety of conventional cable machine attachments that will be recognized by those skilled in the art, including a lateral bar, a curl bar, or an ankle cuff, or any other structure that the user of the machine 10 engages to enable the user to apply a tensile force to the flexible member 54.

The J-hook 146 is incorporated as a substitute for a conventional carabineer clip of the type commonly employed in traditional exercise machines for attaching user interface components to a flexible member. As with the push-locks 94 and 132 described above, the J-hook 146 is in important feature for allowing users who have limited manual dexterity to easily attach and remove interface components. Whereas a carabineer clip requires intricate manual manipulation to fasten and unfasten, the J-hook 146 allows a user to simply place the attachment ring 160 of a user interface over the point of the hook 146. In addition to being easy to use, the J-hook 146 maintains secure engagement with the attachment ring of a user interface under significant loads. Although the J-hook is the preferred means for securing a user interface to the flexible member, various other hooks, clips, and removable fasteners, including conventional carabineer clips, are contemplated.

Referring now to FIGS. 18-23, the resistance assembly 30 includes a pin tower 162, two pin drivers 164 and 166, and a selection interface 168. The pin tower 162 is a vertically elongated housing that is positioned horizontally intermediate the weight stacks 50 and 52. The pin drivers 164 and 166 are mounted to the front and rear of the pin tower 162 in a vertically movable relationship. The pin drivers 164 and 166 are substantially identical, and will now be described with reference to the pin driver 166 on the rear of the pin tower 162. The pin driver 166 includes a conventional solenoid 170 and a two-piece pin 172. The solenoid has a coil 174, a spring 176, and a retention collar 178. The two-piece pin 172 is defined by a driving pin 180 and a locking pin 182. The driving pin 180 axially engages the coil 174 and is held in place by the spring 176 and the retention collar 178. The spring 176 biases the driving pin 180 away from the weight stack 52.

The driving pin 180 is provided with a head 184 having a larger diameter than the shaft 186 of the pin 180. The locking pin 182 has a rounded claw 188 with an interior recess 190 for matingly engaging the shaft 186 and the head 184 of the driving pin 180, respectively. The claw 188 fits over the shaft 186 from above and the head 184 fits into the recess 188 from below, thereby providing secure axial engagement between the driving pin 180 and the locking pin 182 while allowing the locking pin 182 to be moved upwardly, off of the driving pin 180.

The pin tower 160 houses a control unit and a drive system (not shown). The control unit is configured to receive electrical signals from the selection interface 168 for controlling the drive system and the pin driver 166. The drive system moves the pin driver 166 vertically, along recessed tracks in the pin housing (not within view) in response to command signals from the control unit. The control unit can be any type of conventional control unit, including, but not limited to a microcontroller and programmable logic controller. The drive system can be any type of conventional drive system, such as a combination of a conventional servo motor, a conventional series of sprockets or pulleys, and drive chains or belts.

Figure 20:
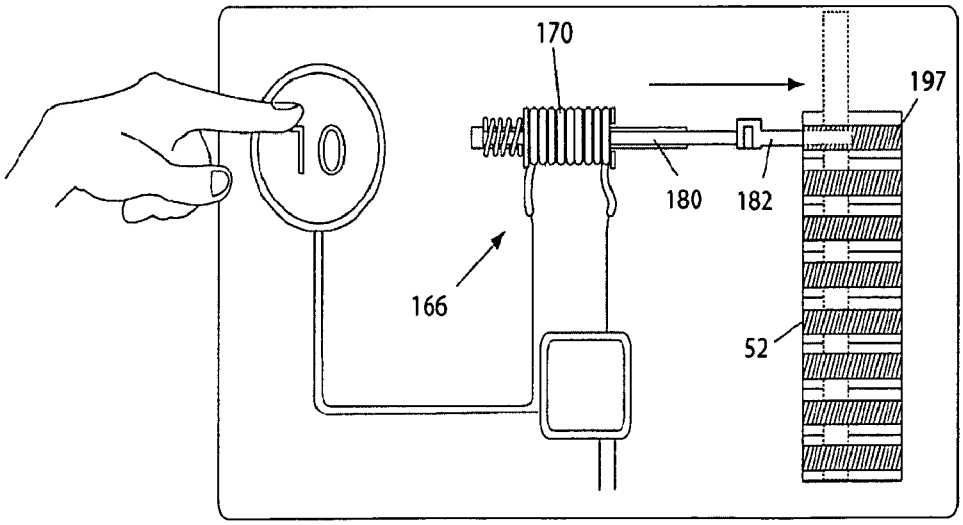
FIG. 20 is a detail view illustrating the pin driver of FIG. 19 with the pin engaging a weight plate.
Figure 21:
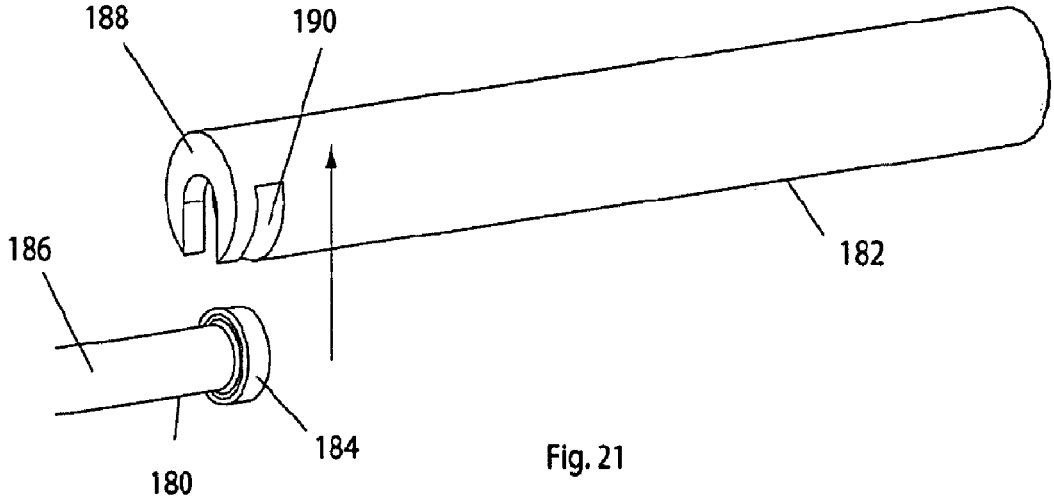
FIG. 21 is a detail view illustrating a two-piece pin of the present invention with the locking pin removed from the driving pin.
Figure 22:
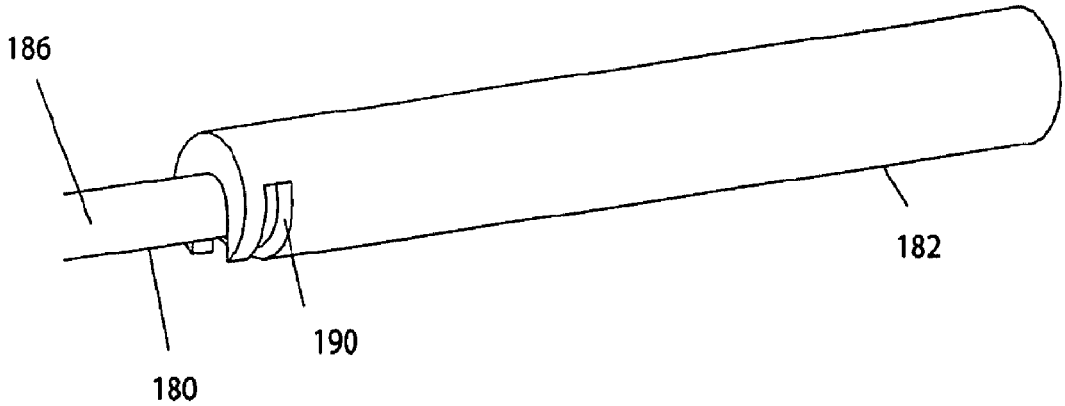
FIG. 22 is a detail view illustrating a two-piece pin shown in FIG. 21 with the locking pin axially engaging the driving pin.

The selection interface 168 is located on the front of the central housing 12 and includes an energized key pad 192 having a plurality of numbered buttons 194 representing the weight increments of the weight stack 52. The interface 168 is electrically coupled to the control unit in the pin tower 162 by a control wire 196. When one of the buttons 194 on the keypad 192 is depressed, an electrical signal is transmitted through the control wire 196 for communicating the selected weight value to the control unit. The control unit then activates the drive system to vertically shift the pin driver 166 until the locking pin 182 is in axial alignment with a pin channel 197 in the proper weight plate. For example, if each of the weight plates weighs 10 pounds, and the user depresses the 10 pound key on the key pad 192, the pin driver 166 will be shifted until the locking pin 182 is in axial alignment with the pin channel 197 in the top weight plate of the weight stack 52. Once the locking pin 182 is properly positioned, the control unit energizes the coil 174 of the solenoid 170. The solenoid 170 then imparts an axial force on the driving pin 180 that is sufficient to overcome the resistance of the spring 176, thereby forcing the driving pin 180 laterally toward the weight stack 52 and shifting the locking pin 182 into axial engagement with the pin channel 197 of the weight plate and a corresponding pin hole in the lift shaft 76 (as shown in FIG. 20). As a user exercises and applies a lifting force to the lift shaft 76, the selected weight plates, and the locking pin 182 travel up and down along the vertical shafts 70 and 72. The engagement between the recessed claw 190 of the locking pin 182 and the head 184 of the driving pin 186 allows the locking pin 182 to be freely lifted off of the driving pin 180 (as shown in FIG. 23) and then returned.

When the user has completed his exercise, the selected weights are brought to rest on the weight stack 52 and the locking pin 182 is brought back into engagement with the driving pin 180. When the user selects a different weight increment on the keypad 192, the control unit de-energizes the solenoid 170, which allows the spring 176 to force the driving pin 180 away from the weight stack 52, thereby drawing the locking pin 182 out of the pin channel of the previously selected weight plate. The process described above is then repeated for selectively engaging another weight plate.

Figure 24:
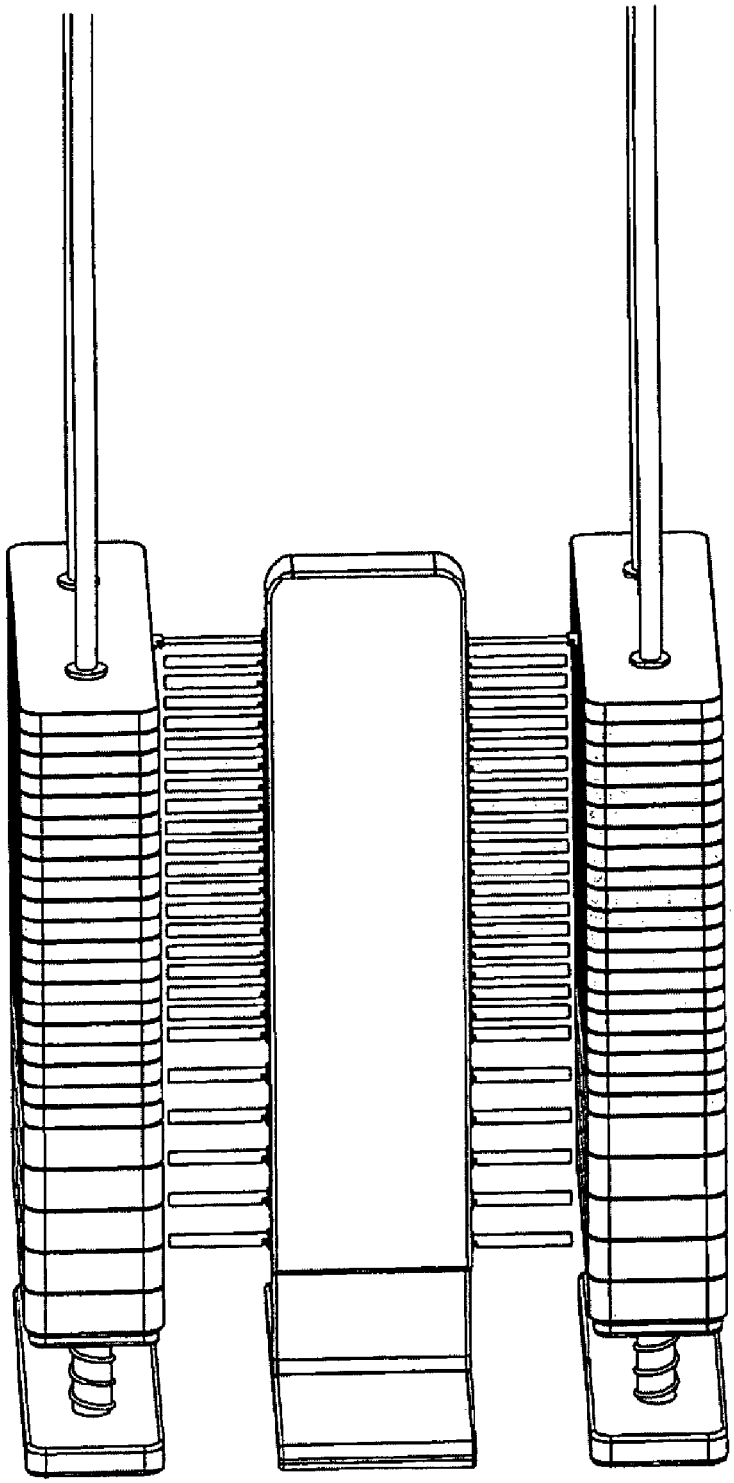
FIG. 24 is a right side view illustrating a solenoid tower of an alternative embodiment of the present invention.
Figure 25:
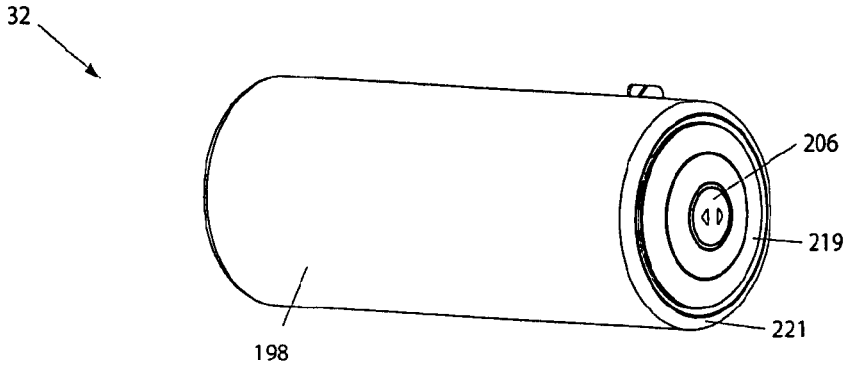
FIG. 25 is a right perspective view illustrating the support pad of the present invention.
Figure 26:
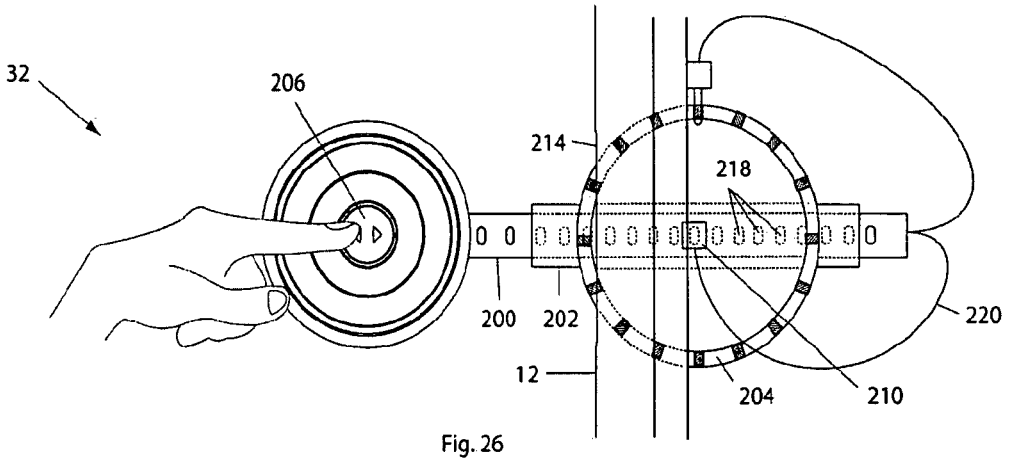
FIG. 26 is a right side detail view illustrating the support pad of the present invention with various components of the pad shown in phantom.
Figure 27:
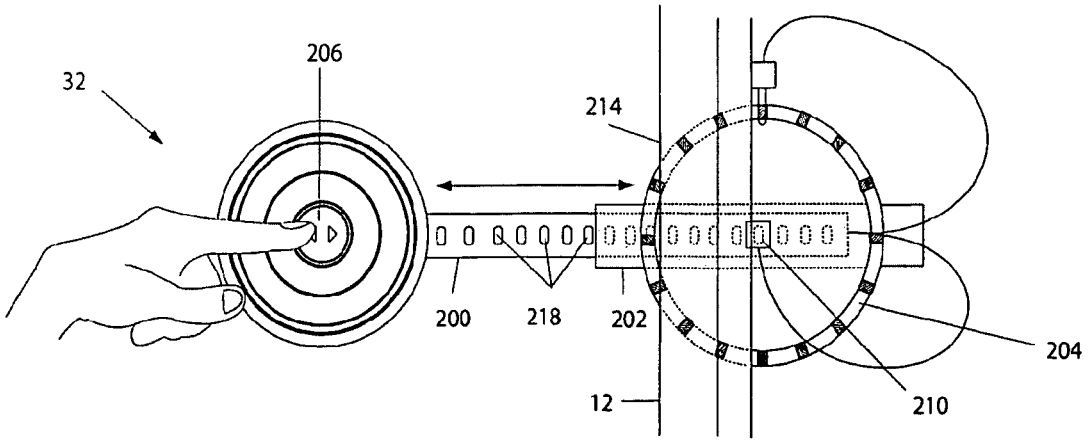
FIG. 27 is a right side detail view illustrating the support pad of FIG. 26 in an extended position.
Figure 28:
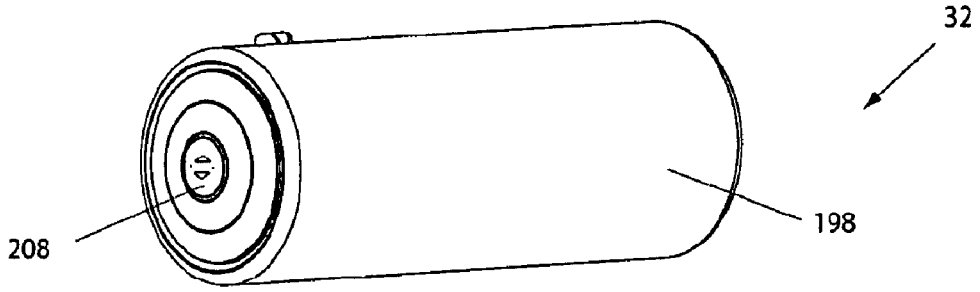
FIG. 28 is a left perspective view illustrating the support pad of the present invention.
Figure 29:
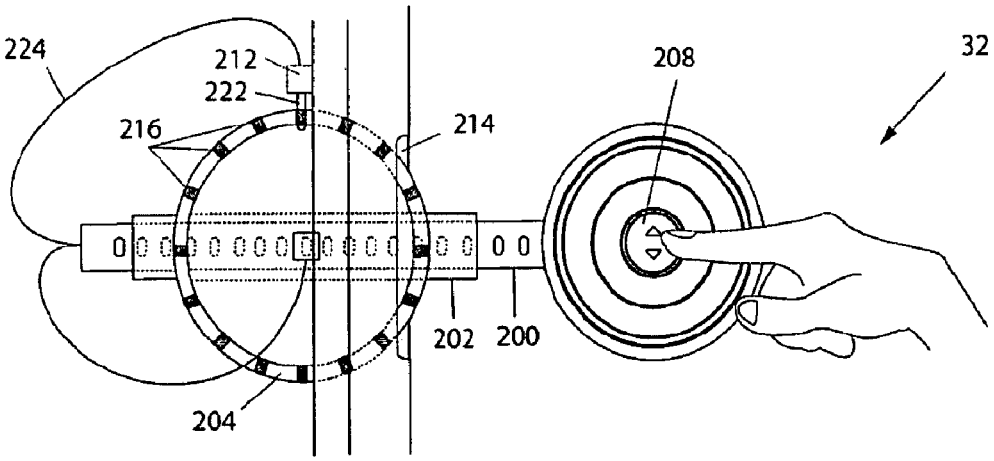
FIG. 29 is a left side detail view illustrating the support pad of the present invention with various components of the pad shown in phantom.
Figure 30:
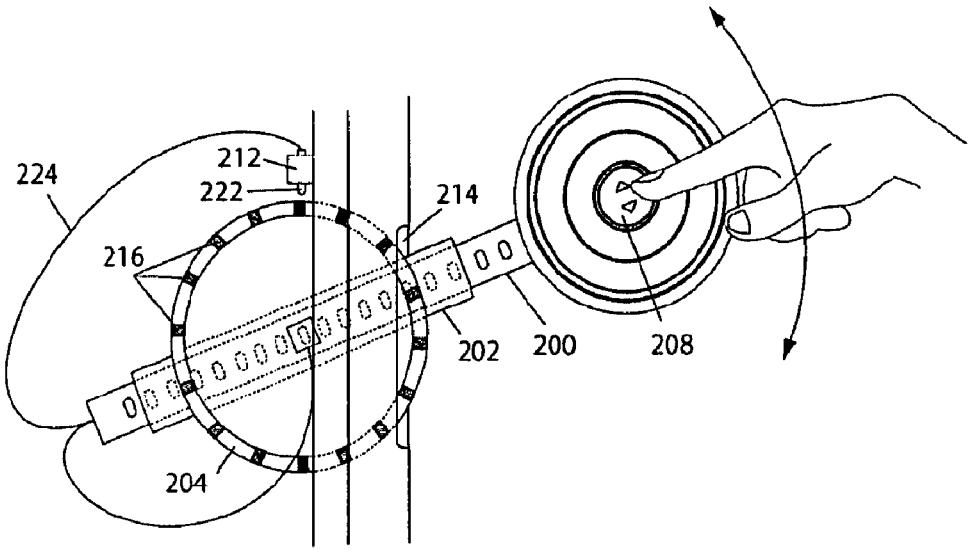
FIG. 30 is a left side detail view illustrating the support pad of FIG. 26 in a pivoted position.

Referring to FIG. 24, an alternative embodiment of the invention 10 is shown in which the drive system of the embodiment described above is omitted and in which the pin tower is provided with a pin driver for each weight plate in the weight stacks. The position of the solenoid of each pin driver is fixed relative to the pin tower, and the locking pin of each driver is axially aligned with the pin hole of a weight plate. When a particular weight is selected by a user, the solenoids that correspond to the appropriate weight plates are energized. No vertical movement of the pin drivers is necessary in this embodiment.

Another alternative embodiment of the invention is contemplated in which conventional hydraulic cylinders are incorporated as an alternative to the solenoids of the pin drivers described above. Yet, another alternative embodiment of the invention is contemplated in which the resistance assembly 30 is entirely omitted, and push-locks, similar to the push-locks 94 and 132 described above, are incorporated for lockably securing the weight plates 62 and 64 of the weight stacks 50 and 52. Yet another embodiment is contemplated in which conventional locking pins, like those incorporated in traditional weight machines, are used for weight selection.

Referring now to FIGS. 1 and 25-30, the adjustable support pad 32 is mounted to the front of the central housing 12 and generally includes a pad 198, an extension shaft 200, an extension sleeve 202, a pivot wheel 204, an extension locking button 206, a pivot locking button 208, and horizontal and vertical pin drivers 210 and 212. The pivot wheel 204 is rotatably mounted to the interior of the housing 12 by a central axle (not within view) for allowing the wheel 204 to freely rotate about its axis. The wheel 204 is vertically oriented and protrudes slightly through a vertically elongated slot 214 formed in the front surface of the housing 12. The wheel 204 is preferably a hollow body and has a plurality of evenly spaced, radially disposed positioning holes 216 formed in its curved surface.

The extension sleeve 202 is a tubular, generally rectangular body that extends through the pivot wheel 204 and is rigidly mounted thereto. The sleeve 202 preferably protrudes several inches from the front and from the rear of the wheel 204 and provides a rectangular passageway therethrough. The sleeve 202 has a locking hole (not within view) formed in one of its sidewalls for providing a horizontal passageway therethrough.

The extension shaft 200 is an elongated, generally rectangular body having exterior dimensions that are substantially equal to the interior dimensions of the extension sleeve 202. The shaft 200 fits axially within the extension sleeve 202 in a close clearance relationship for allowing the shaft 200 to slide axially relative to the sleeve 202. The shaft 200 has a plurality of evenly spaced, longitudinally disposed positioning holes 218 formed in one of its sidewalls for providing a plurality of horizontal passageways therethrough. The positioning holes 218 are longitudinally aligned with the locking hole in the extension sleeve 202, thus allowing various positioning holes to be moved into and out of axial alignment with the locking hole by sliding the shaft 200 relative to the sleeve 202.

The pad 198 is an elongated cylindrical body that is defined by a rigid support member 219 covered with a layer of dense foam padding 221. The pad 198 is rigidly mounted to the front end of the extension shaft 200. Although it is preferred that the pad 198 be cylindrical in shape, it is contemplated that the pad 198 can be a variety of other shapes, including, but not limited to rectangular, triangular, or irregularly shaped to accommodate contoured engagement with various parts of a user's body as will be appreciated by those skilled in the art. It is further contemplated that the pad 198 may be formed of any another type of suitable material and can incorporate any another type of suitable covering, including, but not limited to various plastics, foams, fabrics, and rubber.

The horizontal pin driver 210 is substantially identical in structure and in function to the pin driver 166 described above but has a one-piece pin (not within view) instead of a two-piece pin. The horizontal driver 210 is rigidly mounted to the exterior of the pivot wheel 204 with the one-piece pin axially aligned with and directed toward the locking hole in the extension sleeve 202. The extension locking button 206 is located on the right side of the support pad 32, although it is contemplated that the button 206 can be located anywhere on the machine 10. The pin driver 210 is electrically connected to the extension locking button 206 by a control wire 220 that passes longitudinally through the extension shaft 200. By successively pressing the extension locking button 206, a user can energize and de-energize the solenoid of the horizontal driver 210, thus extending and retracting the one-piece pin into and out of engagement with the locking hole. For example, in order to adjust and secure the longitudinal position of the support pad 32, a user shifts the pad 32 longitudinally until the locking hole is in axial alignment with one of the positioning holes 218. The user then presses the extension locking button 206, which causes the pin to shift axially through an aperture formed in the side of the pivot wheel 204 and into axial engagement with the locking hole and the selected positioning hole. The longitudinal position of the support 32 pad is thereafter fixed until the locking button 206 is pressed again, at which time the one-piece pin will be withdrawn from the holes.

The vertical pin driver 212 is substantially identical in structure and in function to the horizontal pin driver 210. The vertical driver 212 is rigidly mounted to the interior of the central housing 12 adjacent the pivot wheel 204 and has a one-piece pin 222 that is vertically oriented and longitudinally aligned with the positioning holes 216 in the wheel 204. The pivot locking button 208 is located on the left side of the support pad 32, although it is contemplated that the button 208 can be located anywhere on the machine 10. The pin driver 212 is electrically connected to the pivot locking button 208 by a control wire 224 that passes longitudinally through the extension shaft 200. By successively pressing the pivot locking button 208, a user can energize and de-energize the solenoid of the vertical driver 212, thus extending and retracting the one-piece pin 222 into and out of engagement with a selected positioning hole in the pivot wheel 204. For example, in order to adjust and secure the pivoted position of the support pad 32, a user pivots the pad 32 about the central axle until the one-piece pin 222 is in axial alignment with one of the positioning holes 216. The user then presses the pivot locking button 208, which causes the pin 222 to shift into axial engagement with the selected positioning hole. The pivoted position of the support pad 32 is thereafter fixed until the locking button 208 is pressed again, at which time the one-piece pin 222 will be withdrawn from the positioning hole.

An alternative embodiment of the invention is contemplated in which conventional hydraulic cylinders are incorporated as an alternative to the solenoids of the horizontal and vertical pin drivers 210 and 212 described above. Another alternative embodiment of the invention is contemplated in which the vertical and horizontal pin drivers 210 and 212 are omitted, and push-locks, similar to the push-locks 94 and 132 described above, are incorporated for lockably engaging the positioning holes 216 and 218 of the extension shaft 202 and the pivot wheel 204. Yet another embodiment is contemplated in which conventional locking pins, like those incorporated in traditional weight machines, are used for securing the extended and pivoted positions of the support pad 32. It should be noted that all other conventional means for isolating and restricting the movement of a user relative to the central housing 12 may be incorporated in addition, or as an alternative, to the support pad 32 without departing from the spirit of the invention.

Figure 31:
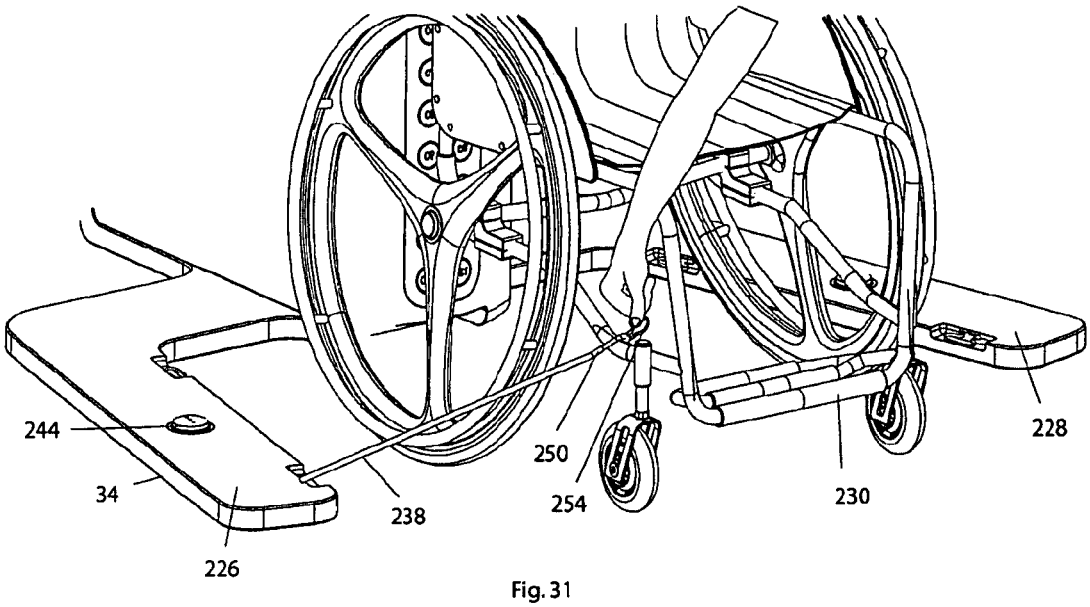
FIG. 31 is a perspective view illustrating the wheelchair stabilization member of the present invention.
Figure 32:
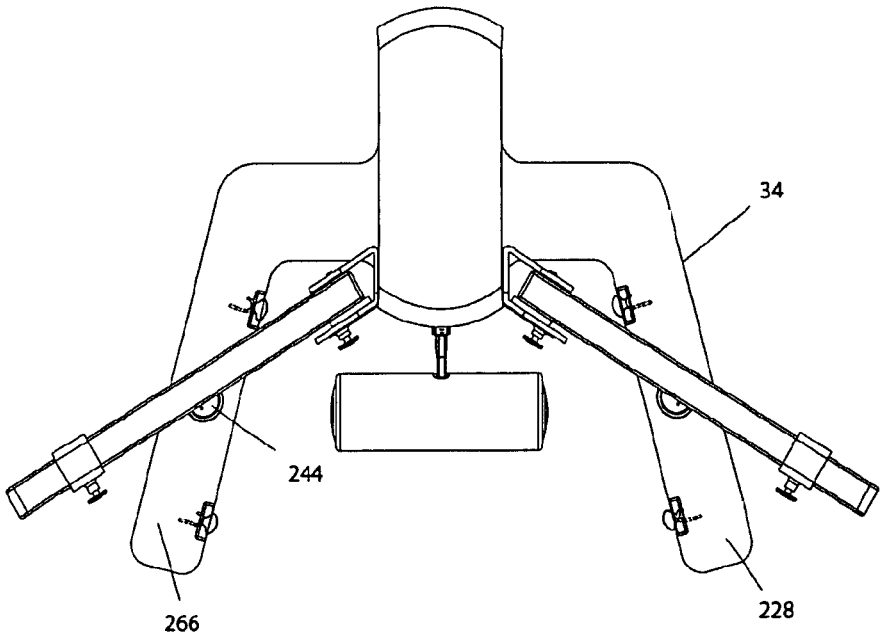
FIG. 32 is a top view illustrating the wheelchair stabilization member of the present invention.
Figure 33:
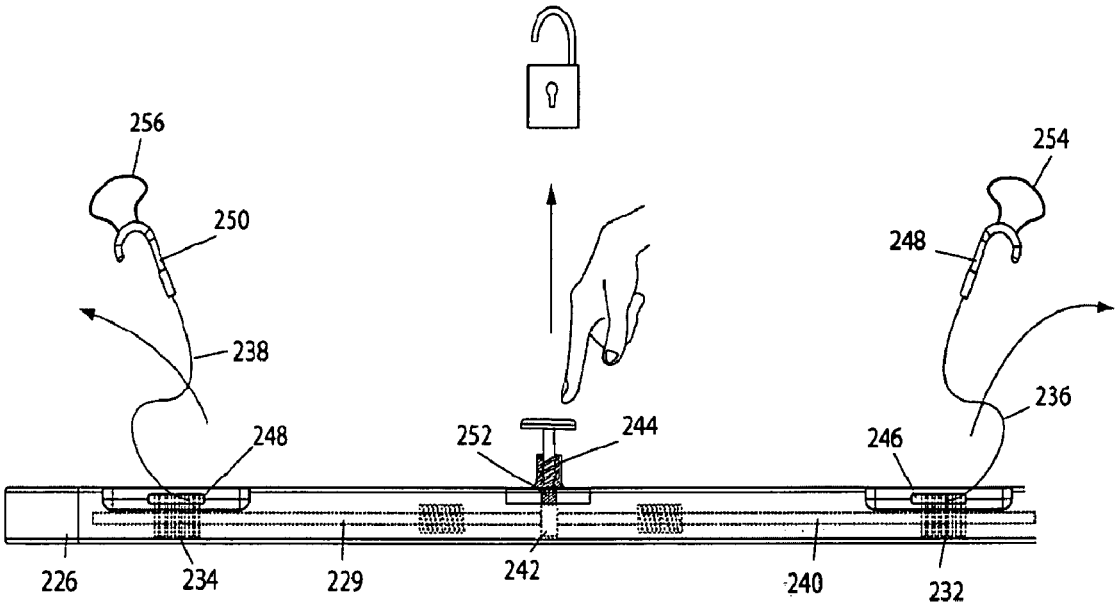
FIG. 33 is a cross-sectional view illustrating the left arm of the wheelchair stabilization member of the present invention with the push-lock shown in an unlocked position.

Referring now to FIGS. 1 and 31-34, the wheelchair stabilization member 34 is a U-shaped body having two arms 226 and 228 that extend forward from the base 38 of the central housing. The arms 226 and 228 are spaced apart from one another a sufficient distance for allowing a wheelchair 230 of conventional size to easily fit therebetween (as shown in FIG. 31). The arms 226 and 228 are substantially identical to one another, and will now be described with reference to the left arm 226 only. A spooling member 229 is located within the arm 226 and generally includes proximal and distal spools 232 and 234, proximal and distal retracting cables 236 and 238, a master axle 240, a locking gear 242, and a push-lock 244.

The proximal and distal spools 232 and 234 are positioned adjacent proximal and distal cable apertures 246 and 248 that are formed in the inward-facing surface of the arm 226. The spools 232 and 234 are vertically oriented (with their axes substantially horizontal) and are rigidly mounted to the master axle 240. The ends of the master axle 240 are rotatably mounted to the interior of the arm 226, such as by mounting in conventional replaceable bearings, for allowing the axle 240, and therefore the spools 232 and 234, to rotate freely about a common horizontal axis.

The proximal and distal retracting cables 236 and 238 are each mounted at one end to the proximal and distal spools 232 and 234, respectively, and terminate in fastening hooks 248 and 250 at their opposite ends. The spools 232 and 234 are rotatably spring-loaded in the manner of a retractable lanyard for keeping the cables 236 and 238 fully wound about the spools 232 and 234 when there is no tensile force applied to the cables 236 and 238. Thus, when a sufficient amount of tensile force is applied to a cable, the resistance of the cable's respective spring can be overcome and the cable can be extended through its corresponding cable aperture. When the tensile force is relaxed, the spool is allowed to rotate in the direction in which it is biased by its spring, thereby pulling the cable back through the aperture and recollecting it about the spool.

Figure 34:
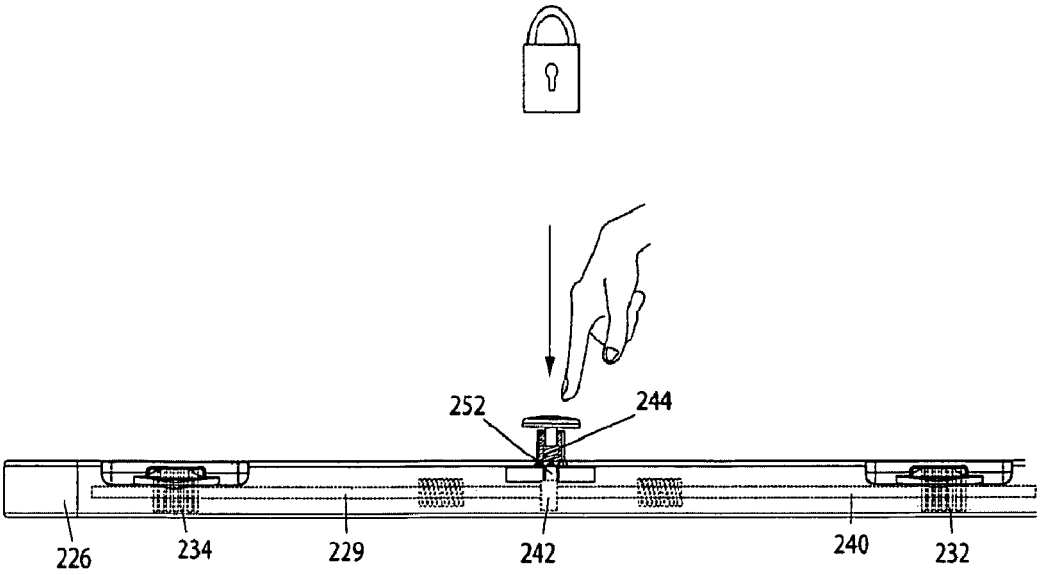
FIG. 34 is a cross-sectional view illustrating the left arm of the wheelchair stabilization member of the present invention with the push-lock shown in a locked position.

The locking gear 242 is rigidly mounted to the master axle 240 in a manner similar to the spools 232 and 234. The gear 242 is vertically oriented and has a plurality of radial gear teeth (not shown). The push-lock 244, which is substantially identical to the push-locks 94 and 132 described above, is mounted to the top surface of the arm 226 and is axially aligned with a locking hole 252 formed therethrough. Thus, when the push-lock 244 is in a locked position (as shown in FIG. 34) the shaft of the lock extends through the locking hole 252 and terminates intermediate two of the gear teeth. The gear 242 is thereby prevented from rotating, which in turn prevents the master axle 240 and the spools 232 and 234 from rotating.

To use the wheelchair stabilization member 34, a user moves his wheelchair 230 between the arms 226 and 228 and positions the chair 230 properly to facilitate a desired exercise. The user then grasps a loop handle 256 that extends from one of the hooks 248 and 250. The loop handles 254 and 256 are provided for allowing users with limited manual dexterity to easily pull and manipulate the hooks 248 and 250. The user then pulls on the handle 256 to extend the hook 250 and the cable 238 toward the wheelchair 230 (as shown in FIG. 31). The hook 250 is then fastened to a front corner of the frame of the wheelchair 230 while the spring-loaded spool 234 keeps the cable 238 taught. The above-described process is repeated with the other hook 248 on the arm 226, with the hook 248 being fastened to a rear corner of the frame of the wheelchair 230. Once both hooks 248 and 250 are securely fastened to the wheelchair 230, the user presses the push-lock 244, thereby locking the locking gear 242 and preventing the cables 236 and 238 from extending any further from the arm 226. The proximal retracting cable 236 thus prevents the wheelchair 230 from moving away from the central housing 12, and the distal retracting cable 238 prevents the wheelchair 230 from moving toward the central housing 12. Together, the cables 236 and 238 prevent the wheelchair 230 from moving or tipping away from the arm 226. The spooling member of the opposite arm 228 operates in a similar fashion to restrict the movement of the wheelchair, thus preventing the wheelchair from moving in any direction while all of the cables of the stabilization member 34 are locked.

An alternative embodiment of the invention is contemplated in which the push-lock 244 is omitted, and a conventional locking pin, like those incorporated in traditional weight machines, is used for securing the locking gear 242 in the arm 226. Yet another embodiment of the invention is contemplated in which wheelchair stabilizing member 34 is entirely omitted. It should be noted that all other conventional means for securing the position of a wheelchair relative to the central housing 12 may be additionally or alternatively incorporated without departing from the spirit of the invention.

Figure 35:
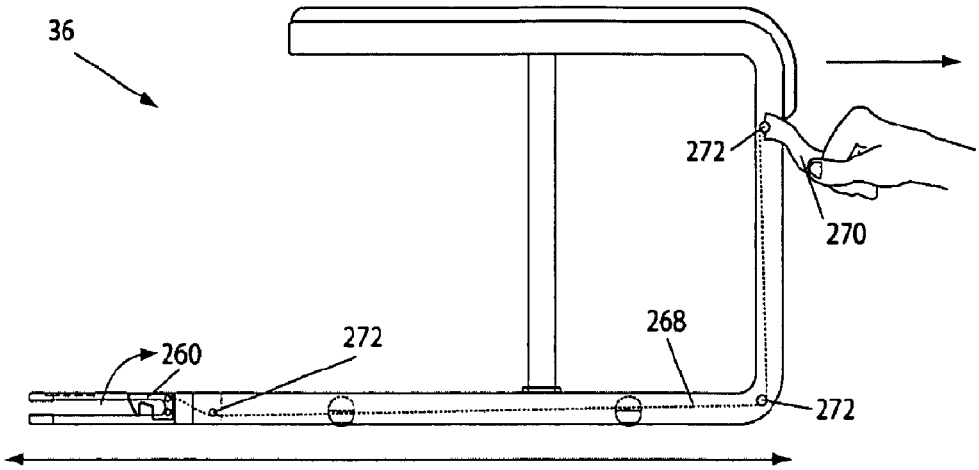
FIG. 35 is a cross-sectional view illustrating the sliding bench of the present invention.
Figure 36:
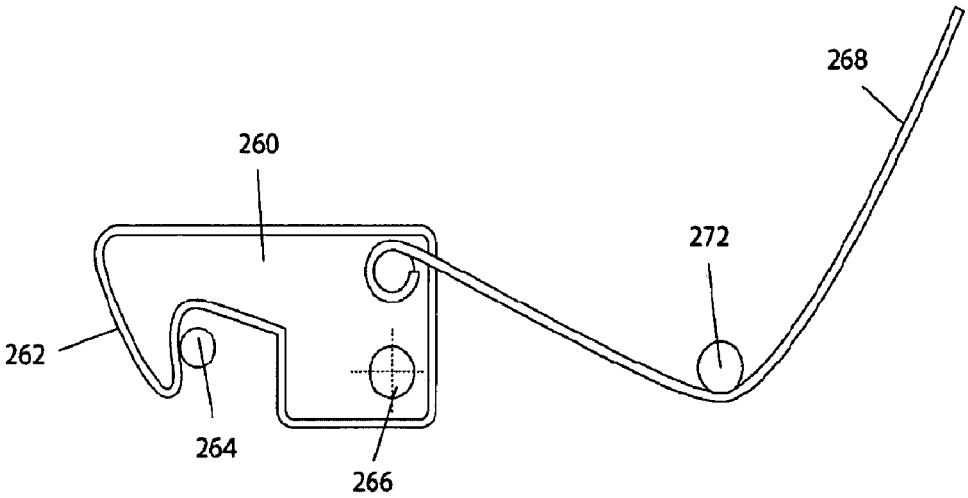
FIG. 36 is a detail view illustrating the connective portion of the sliding bench shown in FIG. 35 with the catch in a locked position.

Referring now to FIGS. 1 and 35-37, the sliding bench 36 is provided for allowing non-wheelchair bound users to perform exercises that require a user to be in a seated position. Although the bench 36 is shown as being generally U-shaped, it is contemplated that the bench 36 can have the shape of any conventional freestanding bench, seat, stool, or chair as will be apparent to those skilled in the art. A spring-loaded, pivoting catch 260 with a hooked tongue 262 is rotatably mounted to the forward-most bottom edge of the bench 36 for engaging a docking bar 264 that is rigidly mounted to the base 38 of the central housing 12. The spring (not shown) of the catch 260 biases the catch 260 toward a down position about an axle pin 266, as shown in FIG. 35. The height of the docking bar 264 relative to the base 38 of the central housing 12 is substantially equal to the height of the tongue 262 relative to the bottom of the bench 36. To lock the bench 36 to the central housing 12, a user slides the bench 36 against the housing 12 and brings the tongue 262 into contact with the docking bar 264. By applying a sufficient amount of lateral force to the bench, a user can overcome the resistance of the catch spring and cause the tongue 262 to pivot upwardly, over the docking bar 264. Once the hooked tongue 262 has cleared the docking bar 264 and the catch spring has forced the catch 260 back to the down position, the engagement between the tongue 262 and the bar 264 thereafter prevents the bench 36 from moving away from the central housing.

Figure 37:
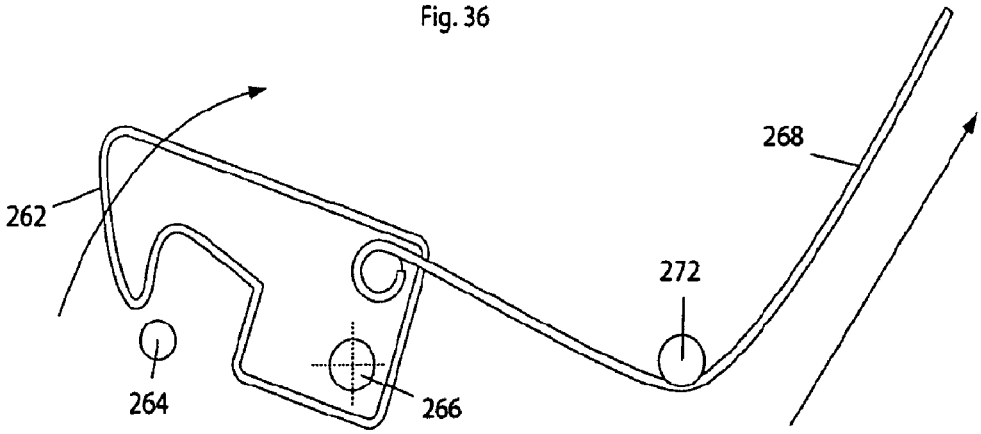
FIG. 37 is a detail view illustrating the connective portion of the sliding bench shown in FIG. 35 with the catch in an unlocked position.

A cable 268 extends from the rear of the catch 260 to a handle 270 that protrudes from the rear of the bench 36. The cable 268 is mounted to the catch 260 above the axle pin 266 and is routed around a series of horizontally oriented shafts 272 within the bench 36. The configuration of the shafts 272 causes the cable 268 to approach the catch 260 from below the cable's point of affixation on the catch 260. Any tensile force in the cable 268 is thus directed toward pulling the catch 260 in a clockwise direction (as shown in FIG. 37) about the axle pin 266. Therefore, when a user pulls the handle 270 with a sufficient amount of force to overcome the catch spring, the tongue 262 is raised over the docking bar 264 thereby allowing the bench 36 to be freely slid away from the central housing.

It is contemplated that the sliding bench 36 can be omitted, and that any type of conventional bench, seat, stool, or chair can be used in its place for supporting a user in a seated position.

Figure 38:
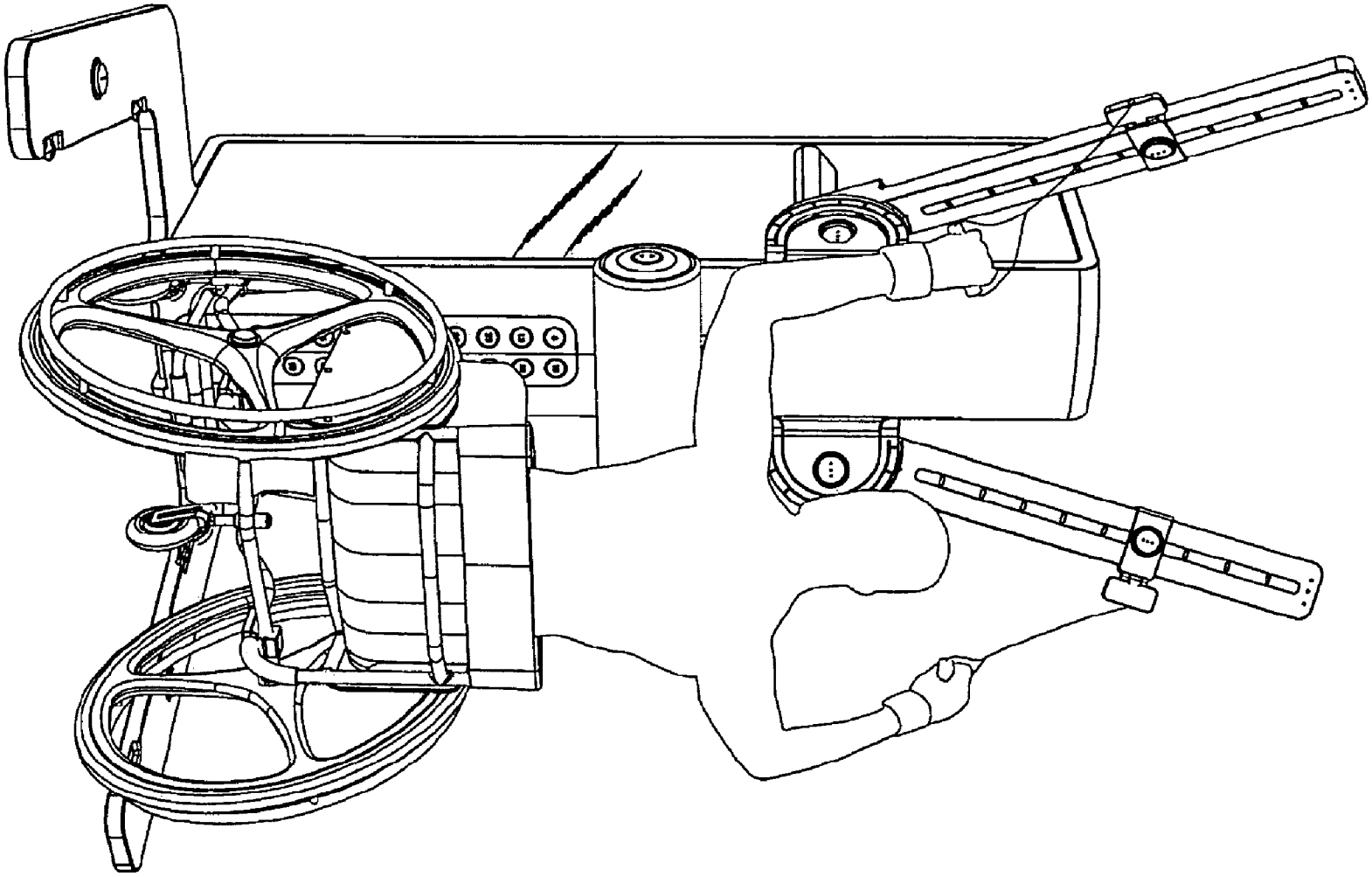
FIG. 38 is a perspective view illustrating the present invention being used to perform a pull down exercise.
Figure 39:
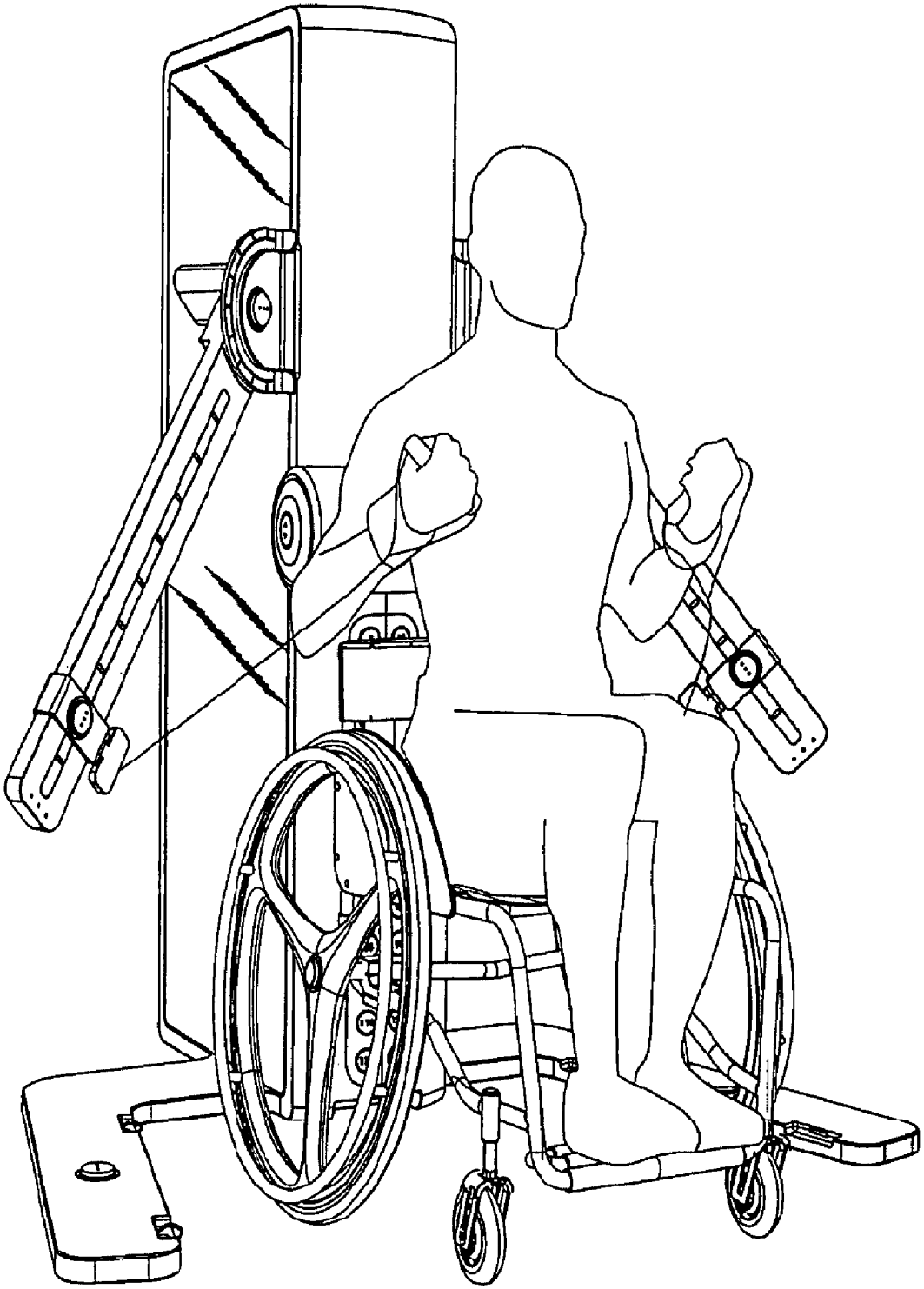
FIG. 39 is a perspective view illustrating the present invention being used to perform a curl exercise.

To operate the exercise machine 10 in a typical fashion, a user first adjusts and locks the angular positions of the extensions arms 14 and 16 and adjusts and locks the longitudinal positions of the cable guides 18 and 20 to facilitate a desired exercise. For example, to accommodate a pull down type exercise, the user locks the arms 14 and 16 in a substantially upward-pointing configuration as shown in FIG. 38. To accommodate a curl type exercise, the user locks the arms 14 and 16 in a substantially downward-pointing configuration as shown in FIG. 39. Although the positions of the arms 14 and 16 and the cable guides 18 and 20 will generally mirror each other when adjusted to facilitate a particular exercise, a user with limited mobility on one side of his body may wish to configure the arms 14 and 16 and the cable guides 18 and 20 differently, such as in an asymmetric configuration, to accommodate his physical limitations. For example, if the user is unable to fully extend one of his arms, he can move one of the cable guides 18 and 20 closer to the central housing 12 relative to the position of the opposite cable guide.

The user then attaches a desired user interface to the J-hook of each of the flexible members 54 and 56. If the user is wheelchair bound, the user then positions his wheelchair intermediate the arms 226 and 228 of the wheelchair stabilization member 34 in a proper orientation for performing the desired exercise. The user then fastens the retractable cables of the stabilization member 34 to his wheelchair and locks the cables in their extended positions. If the user is not wheelchair bound and wishes to perform an exercise that requires him to be in a seated position, the user locks the sliding bench 36 to the housing 12 and properly positions himself on the bench 36.

The user then adjusts and locks the extended and pivoted positions of the support pad 32 to restrict his movement relative to the housing 12 in a manner that facilitates the desired exercise. The user then selects a desired weight increment on the keypad 192 of the selection interface 168, thereby causing locking pins to be shifted into engagement with corresponding weight plates in the weight stacks 50 and 52.

The user next engages the user interfaces and performs the desired exercise in a conventional manner, such as by repeatedly applying sufficient force to the flexible members 54 and 56 to overcome to the resistance provided by the selected weight plates. Although the steps herein are described in a particular order, it will become apparent that the steps can be carried in a variety of orders.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An exercise apparatus comprising:

a) a housing containing a resistance assembly;

b) a first cantilevered extension arm pivotably coupled to the housing near one arm end and a second cantilevered extension arm pivotably coupled to the housing near one arm end;

c) a first cable guide coupled to the first extension arm and longitudinally movable along a straight, linear path thereon and a second cable guide coupled to the second extension arm and longitudinally movable along a straight, linear path thereon;

d) at least one flexible member linked to the resistance assembly and extending between the first and second cable guides for engagement by a user;

e) means for releasably locking the positions of the first and second extension arms relative to the housing; and f) means for releasably locking the longitudinal position of the first cable guide along the first extension arm and for releasably locking the longitudinal position of the second cable guide along the second extension arm.

2. The exercise apparatus of claim 1, wherein said at least one flexible member comprises:

a) a first flexible member linked to the resistance assembly and having a first end affixed to the first cable guide and a second end that extends from the first cable guide for engagement by a user; and b) a second flexible member linked to the resistance assembly and having a first end affixed to the second cable guide and a second end that extends from the second cable guide for engagement by a user.

3. The exercise apparatus of claim 2, wherein the second end of the first flexible member terminates in a J-hook for engaging a user interface.

4. The exercise apparatus of claim 2, wherein the second end of the second flexible member terminates in a J-hook for engaging a user interface.

5. The exercise apparatus of claim 2, wherein the means for releasably locking the position of the first extension arm relative to the housing comprises a spring-loaded, button-operated lock mounted to the housing and having a shaft for axially engaging a positioning hole formed in the first extension arm when the lock is in a locked position, and for disengaging the positioning hole in the first extension arm when the lock is in an unlocked position.

6. The exercise apparatus of claim 5, wherein the means for releasably locking the position of the second extension arm relative to the housing comprises a spring-loaded, button-operated lock mounted to the housing and having a shaft for axially engaging a positioning hole formed in the second extension arm when the lock is in a locked position, and for disengaging the positioning hole in the second extension arm when the lock is in an unlocked position.

7. The exercise apparatus of claim 2, wherein the means for releasably locking the position of the first cable guide relative to the first extension arm comprises a spring-loaded, button-operated lock mounted to the first cable guide and having a shaft for axially engaging a positioning hole formed in the first extension arm when the lock is in a locked position, and for disengaging the positioning hole in the first extension arm when the lock is in an unlocked position.

8. The exercise apparatus of claim 7, wherein the means for releasably locking the position of the second cable guide relative to the second extension arm comprises a spring-loaded, button-operated lock mounted to the second cable guide and having a shaft for axially engaging a positioning hole formed in the second extension arm when the lock is in a locked position, and for disengaging the positioning hole in the second extension arm when the lock is in an unlocked position.

9. The exercise apparatus of claim 2, wherein the resistance assembly comprises:

a) at least one weight stack having a plurality of weights, each weight having a locking channel formed therein;

b) a solenoid tower having at least one solenoid movably mounted thereto that is adapted to insert a pin into the locking channel of one of said plurality of weights when said at least one solenoid is activated and to withdraw the pin out of the locking channel of one of said plurality of weights when said at least one solenoid is deactivated; and c) a control panel operatively connected to the solenoid tower for allowing a user to move the pin into alignment with the locking channel of a desired weight and activate said at least one solenoid.

10. The exercise apparatus of claim 2, wherein the resistance assembly comprises:

a) at least one weight stack having a plurality of weights, each weight having a locking channel formed therein;

b) a solenoid tower having a plurality of solenoids mounted thereto, each solenoid having a pin that is aligned with the locking channel of one of said plurality of weights and being adapted to insert the pin into the locking channel when the solenoid is activated and to withdraw the pin out of the locking channel when the solenoid is deactivated; and c) a control panel operatively connected to the solenoid tower for allowing a user to activate one of said plurality of solenoids that corresponds to a desired weight.

11. The exercise apparatus of claim 2, further comprising a support pad extending from the housing for engaging the body of a user, the support pad configured to adjustably articulate and extend relative to the housing.

12. The exercise apparatus of claim 11, further comprising a button-operated lock for locking and unlocking the adjustably extended position of the support pad relative to the housing.

13. The exercise apparatus of claim 11, further comprising a button-operated lock for locking and unlocking the adjustably articulated position of the support pad relative to the housing.

14. The exercise apparatus of claim 1, further comprising a wheelchair stabilization member extending from the housing for securing a wheelchair thereto, the stabilization member having two arms that are spaced apart from one another for accommodating a wheelchair therebetween, each arm having at least one fastening cable extending therefrom for engaging a wheelchair.

15. The exercise apparatus of claim 14, wherein said at least one fastening cable is retractable.

16. The exercise apparatus of claim 14, wherein said at least one fastening cable releasably locks in an extended position.

17. The exercise apparatus of claim 2, further comprising a sliding bench that can be releasably locked to the housing by a catch, the bench having a handle operatively coupled to the catch for allowing a user to unlock the bench from the housing by pulling the handle.

18. An exercise apparatus comprising:

a) a housing containing a resistance assembly;

b) a first extension arm pivotably coupled to the housing and a second extension arm pivotably coupled to the housing;

c) a first cable guide movably coupled to the first extension arm and a second cable guide movably coupled to the second extension arm;

d) at least one flexible member linked to the resistance assembly and extending between the first and second cable guides for engagement by a user;

e) means for releasably locking the positions of the first and second extension arms relative to the housing;

f) means for releasably locking the longitudinal position of the first cable guide along the first extension arm and for releasably locking the longitudinal position of the second cable guide along the second extension arm; and g) a wheelchair stabilization member extending from the housing for securing a wheelchair thereto, the stabilization member having two arms that are spaced apart from one another for accommodating a wheelchair therebetween, each arm having at least one fastening cable therefrom for engaging a wheelchair.

19. The exercise apparatus of claim 18, wherein said at least one fastening cable is retractable.

20. The exercise apparatus of claim 18, wherein said at least one fastening cable releasably locks in an extended position.

21. A method for adjusting the configuration of an exercise apparatus having a housing, a first pivoting, cantilevered extension arm, and a second pivoting, cantilevered extension arm, the method comprising:

a) adjusting an angular position of the first extension arm relative to the housing and locking the position of the first extension arm with a first button-operated lock;

b) adjusting an angular position of the second extension arm relative to the housing and locking the position of the second extension arm with a second button-operated lock;

c) adjusting a position of a first movable cable guide longitudinally along a straight, linear path on the first extension arm and locking the position of the first movable cable guide with a third button-operated lock; and d) adjusting a position of a second movable cable guide longitudinally along a straight, linear path on the second extension arm and locking the position of the second movable cable guide with a fourth button-operated lock.

22. The method of claim 21, further comprising securing a wheelchair relative to the housing with at least one retractable fastening cable.

23. The method of claim 21, further comprising adjusting a position of a support pad that extends from the housing and locking the position of the support pad with a fifth button-operated lock.

24. A method for adjusting the configuration of an exercise apparatus having a housing, a first pivoting extension arm, and a second pivoting extension arm, the method comprising:

a) adjusting an angular position of the first extension arm relative to the housing and locking the position of the first extension arm with a first button-operated lock;

b) adjusting an angular position of the second extension arm relative to the housing and locking the position of the second extension arm with a second button-operated lock;

c) adjusting a position of a first movable cable guide longitudinally relative to the first extension arm and locking the position of the first movable cable guide with a third button-operated lock;

d) adjusting a position of a second movable cable guide longitudinally relative to the second extension arm and locking the position of the second movable cable guide with a fourth button-operated lock; and e) securing a wheelchair relative to the housing with at least one retractable fastening cable.

* * * * *